US008061668B1

(12) United States Patent
Cvek

(10) Patent No.: US 8,061,668 B1
(45) Date of Patent: Nov. 22, 2011

(54) ADJUSTABLE ERGONOMIC KEYBOARD, MOUSE, AND WRIST SUPPORT

(76) Inventor: Sava Cvek, Jamaica Plain, MA (US)

( * ) Notice: Subject to any disclaimer, the term of this patent is extended or adjusted under 35 U.S.C. 154(b) by 10 days.

(21) Appl. No.: 12/495,817

(22) Filed: Jul. 1, 2009

Related U.S. Application Data

(63) Continuation-in-part of application No. 12/410,459, filed on Mar. 24, 2009, now Pat. No. 7,946,551.

(51) Int. Cl.
*E04G 3/00* (2006.01)

(52) U.S. Cl. ..... 248/291.1; 248/118; 248/918

(58) Field of Classification Search ..... 248/118, 248/118.1, 291.1, 292.14, 284.1, 286.1, 918; 361/679.2; 108/286.1, 138, 50.01, 2
See application file for complete search history.

(56) References Cited

U.S. PATENT DOCUMENTS 5,163,646 A * 11/1992 Engelhardt
5,257,767 A * 11/1993 McConnell
5,335,888 A * 8/1994 Thomsen
5,356,099 A * 10/1994 Sereboff
5,443,237 A * 8/1995 Stadtmauer
5,490,466 A * 2/1996 Diffrient
5,775,657 A * 7/1998 Hung
5,826,839 A * 10/1998 Chen
5,878,674 A * 3/1999 Allan
5,904,327 A * 5/1999 Cheng
5,918,839 A * 7/1999 Dubois
6,048,325 A * 4/2000 Kendall et al.
6,158,359 A * 12/2000 Allan et al.
6,176,456 B1 * 1/2001 Wisniewski
6,179,261 B1 * 1/2001 Lin
6,186,460 B1 * 2/2001 Lin
6,219,867 B1 * 4/2001 Yates
6,257,531 B1 * 7/2001 Penner
6,273,382 B1 * 8/2001 Pemberton
6,322,031 B1 * 11/2001 LeClair et al.
6,328,266 B1 * 12/2001 Yates
6,332,596 B1 * 12/2001 Su
6,336,614 B1 * 1/2002 Kwitek
6,409,127 B1 * 6/2002 VanderHeide et al.
6,478,266 B1 * 11/2002 Tsau
6,506,271 B1 * 1/2003 Yates
6,565,055 B1 * 5/2003 Timm
6,616,108 B1 * 9/2003 Brophy et al.
6,626,403 B1 * 9/2003 Wolf et al.
6,663,056 B1 * 12/2003 Lee
6,672,548 B1 * 1/2004 Yates
7,004,438 B2 * 2/2006 Lin
2001/0000616 A1 * 5/2001 West et al.
2001/0028023 A1 * 10/2001 Kochanski et al.
2002/0166927 A1 * 11/2002 Kollar
2003/0029980 A1 * 2/2003 Barber
2003/0042379 A1 * 3/2003 Lin
2003/0042380 A1 * 3/2003 Hagglund et al. ..... 248/286.1
2003/0058609 A1 * 3/2003 Garel et al. ..... 361/683
2004/0099779 A1 * 5/2004 Mileos et al. ..... 248/281.11
(Continued)

*Primary Examiner* — Ramon Ramirez
(74) *Attorney, Agent, or Firm* — O'Connell Law Firm

(57) ABSTRACT

A keyboard, mouse, and wrist support arrangement with a pivotable transverse member, first and second elongate rails in combination with slide rails for slidably receiving the first and second elongate rails for retaining the pivotable transverse member for extension and retraction and for pivoting about a lateral pivot axis, a keyboard support plate retained relative to the pivotable transverse member, and a keyboard wrist support retained relative to the keyboard support plate. A mouse support plate, which can be independently moveable in relation to the keyboard support plate, can be retained relative to the pivotable transverse member, and a mouse wrist support retained relative to the mouse support plate.

24 Claims, 37 Drawing Sheets

U.S. PATENT DOCUMENTS

2004/0179331 A1* 9/2004 Maloney
2004/0262477 A1* 12/2004 Whitaker et al. ..... 248/284.1
2005/0105255 A1* 5/2005 Kirchhoff ..... 361/680
2005/0224671 A1* 10/2005 Lin ..... 248/289.11

* cited by examiner

FIG. 28
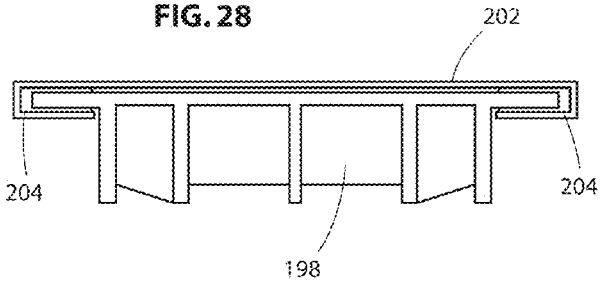
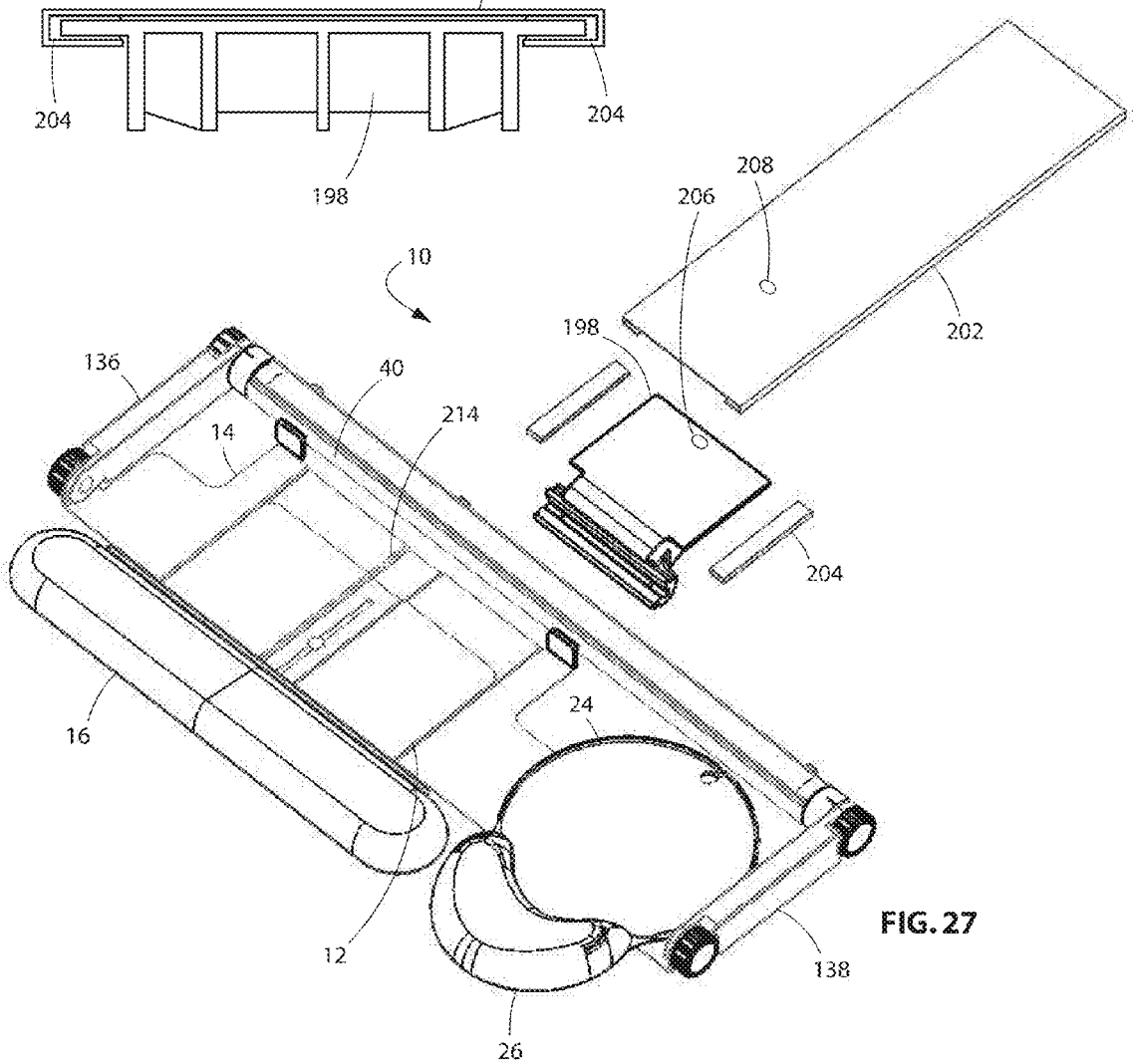
FIG. 27

ADJUSTABLE ERGONOMIC KEYBOARD, MOUSE, AND WRIST SUPPORT

PRIORITY

Continuation-in-Part of application Ser. No. 12/410,459, filed Mar. 24, 2009, now U.S. Pat. No. 7,946,551, issued May 24, 2011

FIELD OF THE INVENTION

The present invention relates generally to support arrangements. More particularly, disclosed herein is an adjustable ergonomic keyboard tray and mousepad support system for providing effective and comfortable support to a computer user's keyboard, mouse, and wrists.

BACKGROUND OF THE INVENTION

Computer workstations typically include a computer monitor, a keyboard, and a computer mouse. However, many users find the reaching required to access a keyboard on the desktop over the course of an entire day to be a source of discomfort and, in certain cases, physical injury. Furthermore, keyboards retained on a desktop occupy otherwise usable space thereby reducing the available desktop.

Accordingly, keyboard drawers and other supports are often employed to conserve space and to enable an adjustment of the distance of the keyboard from the user. In such devices, a tray is typically provided for supporting the keyboard. The tray is movable, usually by sliding, from a retracted, storage position to an extended position for use.

Other keyboard supports have been disclosed that provide further ergonomic benefits to the user, including by enabling an adjustment of keyboard height and angle. However, the keyboard supports of the prior art are often difficult to adjust. Furthermore, they are typically limited in the keyboard adjustment options that are necessary to achieve the desired ergonomic benefits. Still further, most keyboard support arrangements provide no means for supporting a separate computer mouse thereby still requiring the user to reach for the desktop repeatedly and to set aside a workspace on the desktop for the mouse.

The present inventor has further recognized that the keyboard supports of the prior art also fail to provide adequate support to the user's wrists. The failure to provide adequate, ergonomically sound support to user's wrist during the repetitive motions involved in data entry and other continual computer usage can lead to discomfort and a variety of possible injuries. One common repetitive stress disorder is carpal tunnel syndrome, a disorder that can lead to debilitating pain in the wrists of those who use keyboards and other data entry devices. Carpal tunnel syndrome is believed to develop as the hands and wrists of the user are held in an unnatural position during repetitive tasks performed over a prolonged period of time.

A number of devices have been disclosed by the prior art with the goal of improving wrist support to prevent pain and injury deriving from repetitive computer usage. One common device is a wrist brace. Although they do provide support, wrist braces are restrictive and awkward and often leave the user sweating within the cast-like devices. The prior art also has disclosed innumerable types of pads designed to rest on the desk or other support surface to provide an elevated wrist support. Disadvantageously, such pads are often insufficiently flexible and provide a continuous surface of substantially impermeable material. With that, the user is again faced with discomfort and undesirable heat and perspiration.

With an appreciation for the foregoing, the present inventor has appreciated that there is a need in the art for an adjustable support for a computer keyboard that is capable of additionally providing adjustable support to a computer mouse while also providing ergonomically sound, breathable support to the wrists of a user.

SUMMARY OF THE INVENTION

Advantageously, embodiments of the present invention are founded on the basic object of providing an adjustable ergonomic support for a keyboard and mouse that also provides ergonomically sound support to a user's wrists.

Another object of embodiments of the invention is to provide wrist support to computer users that is comfortable and breathable.

A further object of the invention in certain embodiments is to provide an adjustable ergonomic support that enables an adjustment of the relative support position of a computer mouse in relation to a computer keyboard.

Still another object of the invention is to provide an adjustable ergonomic support that can be readily adjusted from a use position for enabling comfortable computer usage to a storage position for enabling improved workspace availability.

These and further objects and advantages of embodiments of the invention will become obvious not only to one who reviews the present specification and drawings but also to one who has an opportunity to make use of an embodiment of the instant invention for an ergonomic keyboard, mouse, and wrist support arrangement disclosed herein. The accomplishment of each of the foregoing and possibly further objects in a single embodiment of the invention may be possible and indeed preferred. However, it will be appreciated that not all embodiments will seek or need to accomplish each and every potential object and advantage. Nonetheless, all such embodiments should be considered to be within the scope of the present invention.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The invention may be more completely understood with reference to the accompanying drawings, in which:

FIG. 27 is a partially exploded view of the keyboard, mouse, and wrist support of FIG. 26;

FIG. 28 is a cross-sectional view of the central arm support arrangement of FIGS. 26 and 27;

DETAILED DESCRIPTION OF PREFERRED EMBODIMENTS

It will be appreciated that the ergonomic keyboard, mouse, and wrist support arrangement disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction, descriptions of geometry, and illustrations of inventive concepts are mere examples of the many possible manifestations of the invention.

Figure 1:
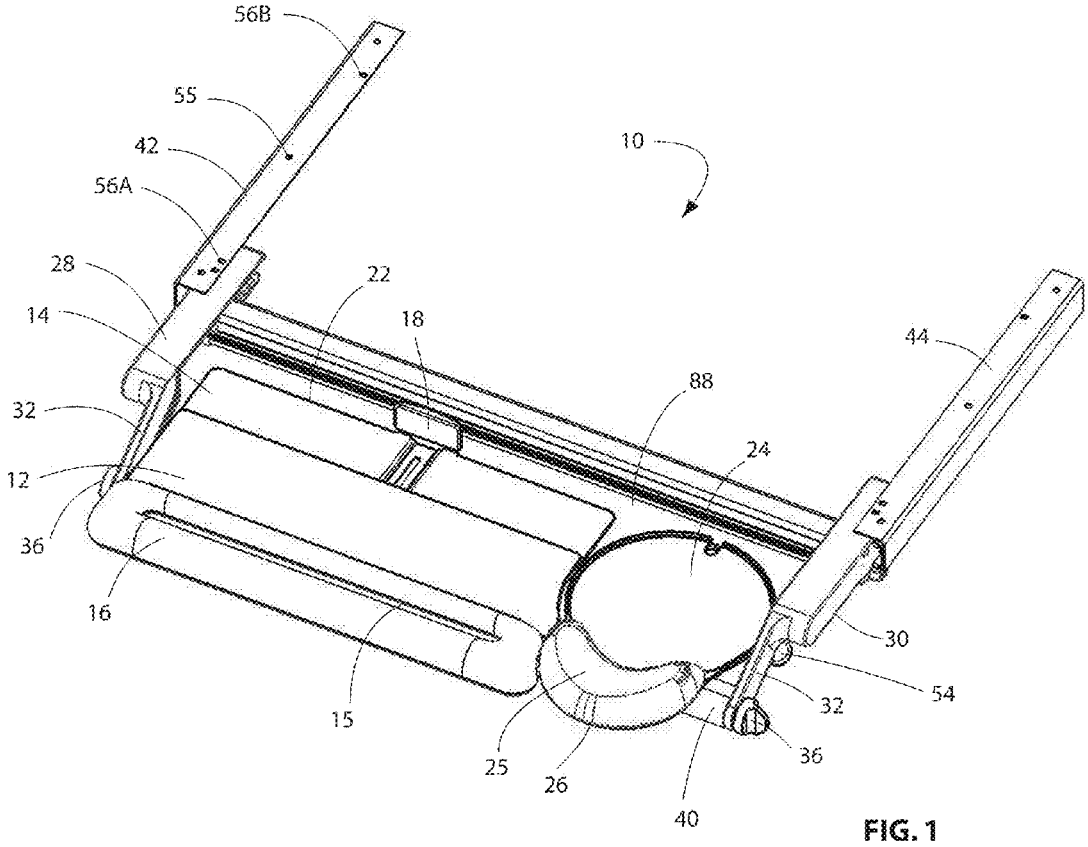
FIG. 1 is an upper perspective view of an adjustable ergonomic keyboard, mouse, and wrist support according to the present invention.
Figure 2:
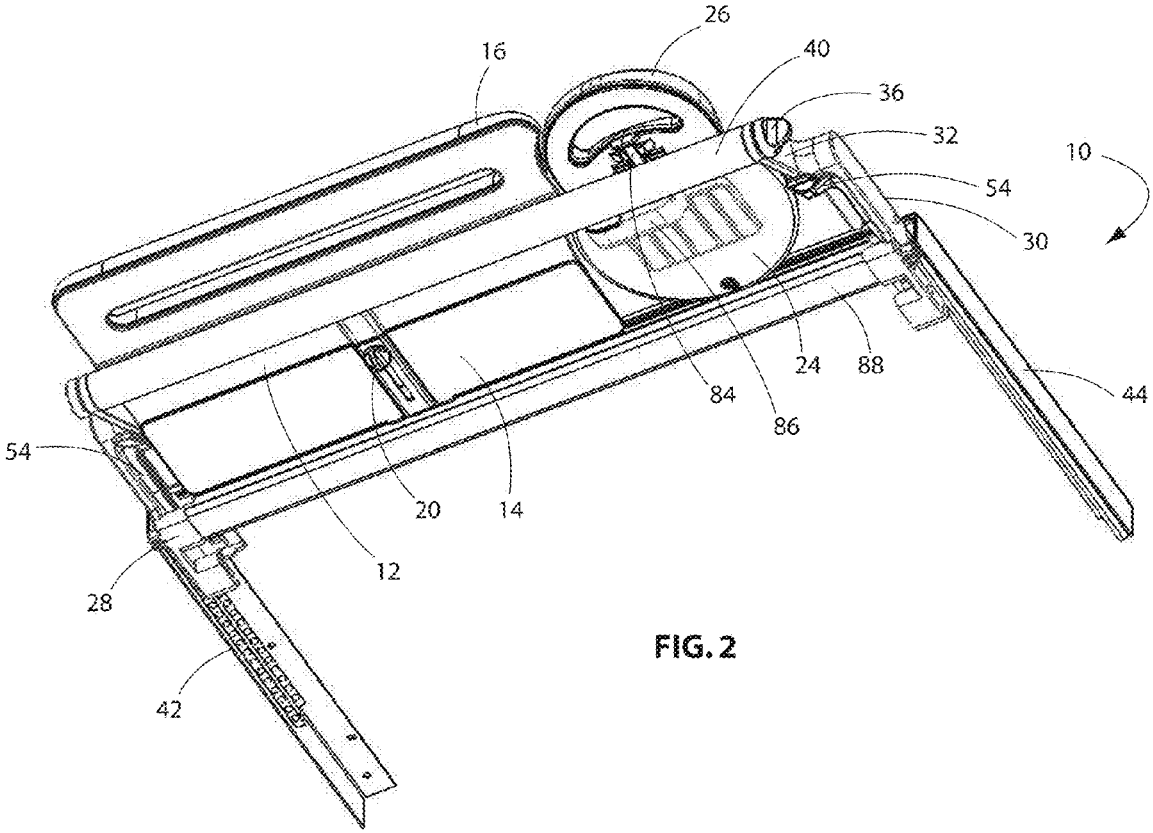
FIG. 2 is a lower perspective view of the adjustable ergonomic keyboard, mouse, and wrist support of FIG. 1.

Looking more particularly to the drawings, a keyboard, mouse, and wrist support arrangement pursuant to the present invention is indicated generally at 10 in, for example, FIGS. 1 and 2. The support arrangement 10 has a pivotable transverse member 40 with first and second ends pivotally coupled to distal ends of arms 32 at pivot axes established by angular adjustment knobs 36. The arms 32 are fixed at a downward angle relative to distal ends of first and second opposed first and second elongate rails 28 and 30. A stabilizing bar 88 has a first end fixed to the elongate rail 28 adjacent to the inner end thereof, a second end fixed to the second elongate rail 30 adjacent to the inner end thereof, and a stabilizing body portion connecting the elongate rails 28 and 30.

Figure 4A:
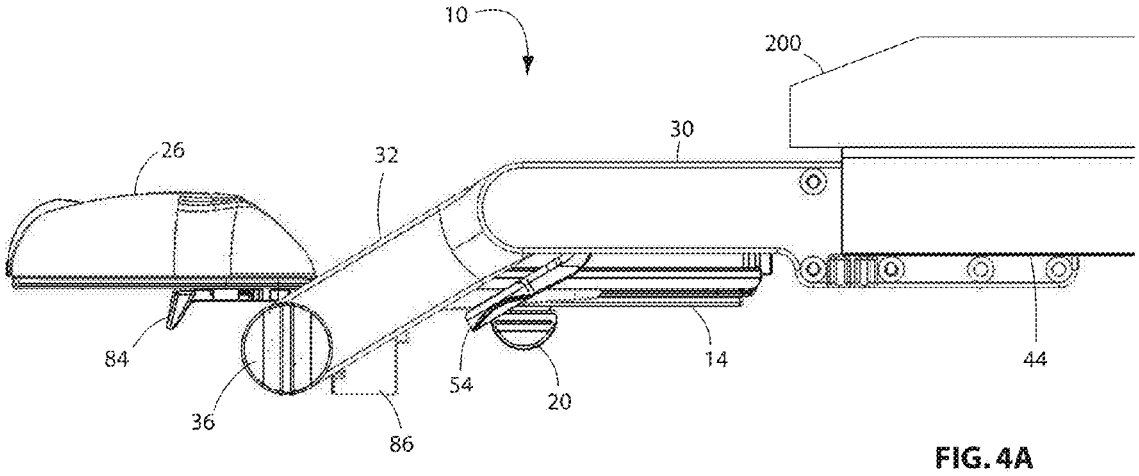
FIG. 4A is a view in side elevation of a portion of the adjustable ergonomic keyboard, mouse, and wrist support mounted to a support surface.

The elongate rails 28 and 30 are slidably retained by first and second slide rails 42 and 44 by any appropriate means including, for example, a ball bearing arrangement to ensure smooth sliding characteristics. The first and second slide rails 42 and 44 can be fixed to an external support surface 200, such as to the underside of a desktop or countertop, as is shown in, for example, FIGS. 4A and 4B. Any suitable fastening means could be employed, including mechanical fasteners passed through apertures 55 in the slide rails 42 and 44.

A first keyboard support plate 12 is retained relative to the transverse member 40 for slidable and pivotal movement therewith. A second keyboard support plate 14 is slidably engaged with the first keyboard support plate 12 by a sliding engagement between a slot 22 in the second keyboard support plate 14 and a fastener 20 passing through the first keyboard support plate 12 and the slot 20. Together, the first and second keyboard support plates 12 and 14 form an adjustable keyboard platform.

Figure 8A:
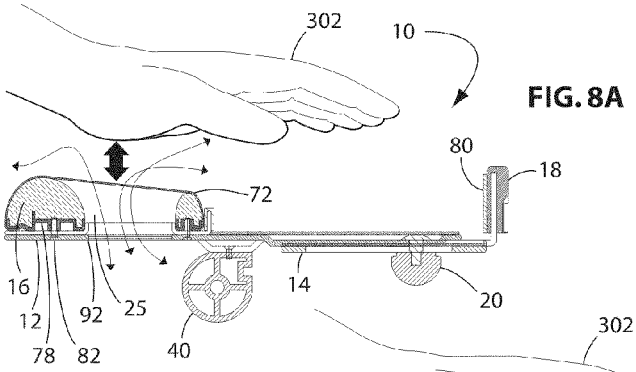
FIGS. 8A, 8B, and 8C are progressive cross-sectional views of a keyboard wrist support according to the present invention.
Figure 8B:
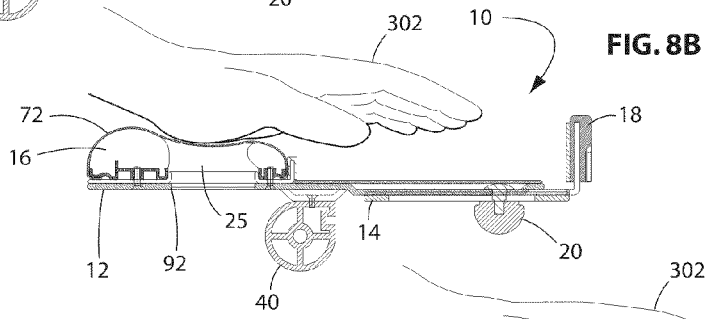
Figure 8C:
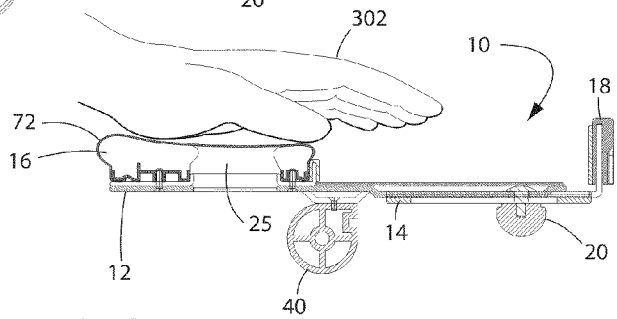

An upstanding clamping member 18 is fixed relative to an inner edge of the second keyboard support plate 14, and a raised keyboard wrist support 16 is retained toward or relative to an outer portion of the first keyboard support plate 12. With this, a keyboard 400 can be securely retained atop the keyboard platform formed by the first and second keyboard support plates 12 and 14 as shown, for example, in FIG. 10. The keyboard 400 can then be effectively clamped in place by a sliding of the second keyboard support plate 14 toward the first keyboard support plate 12 and a locking in that position by use of the fastener 20. With this, the keyboard 400 can be frictionally retained by the inboard surface of the clamping member 18 and the inboard surface 100 of a base plate 98 of the keyboard wrist support 16. A friction pad 80 can be disposed on the inboard surface of the clamping member 18 as shown in FIGS. 8A, 8B, and 8C to ensure a most secure retention of the keyboard 400.

Figure 10:
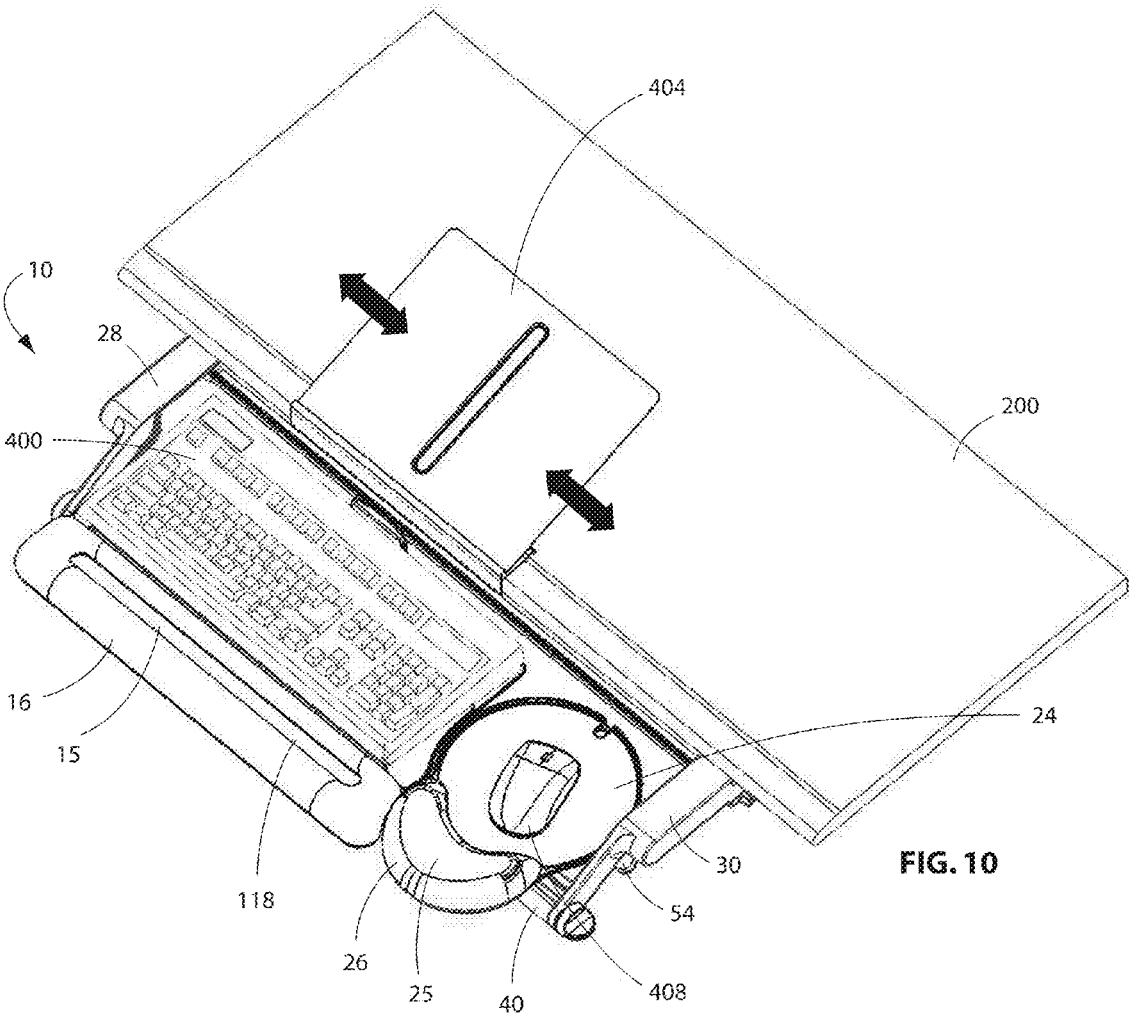
FIG. 10 is an upper perspective view of an alternative embodiment of the ergonomic keyboard, mouse, and wrist support disclosed herein.

A mouse support plate 24, which in the depicted embodiment is separate from the keyboard support plates 12 and 14, is also retained relative to the transverse member 40. A mouse wrist support 26 is retained relative to an outer portion of the mouse support plate 24. With this, a mouse 408 can be disposed atop the mouse support plate 24 as shown in FIG. 10. The wrist and hand of the user can thus enjoy support from the mouse wrist support 26.

As will be described further hereinbelow, the mouse support plate 24 and the mouse wrist support 26 could be moveable in relation to the keyboard support platform. For example, the mouse support plate 24 can be slidably and, potentially, pivotally retained relative to the transverse member 40 whereby the relative location and orientation of the mouse support plate 24, and thus the retained mouse 408, can be adjusted.

Figure 6:
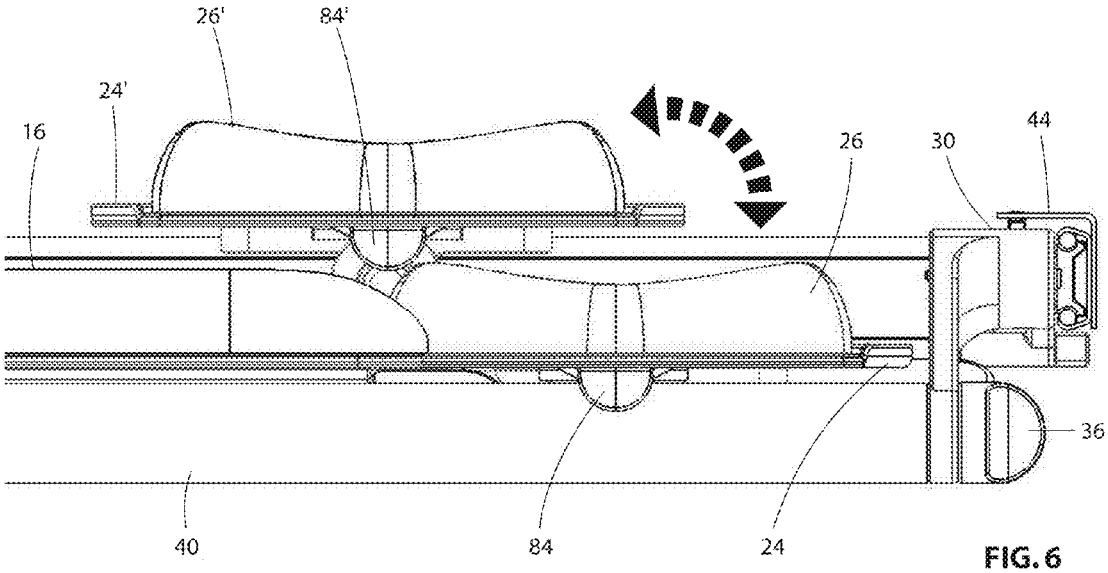
FIG. 6 is a view in front elevation of a mouse supporting portion of the ergonomic keyboard, mouse, and wrist support.
Figure 7A:
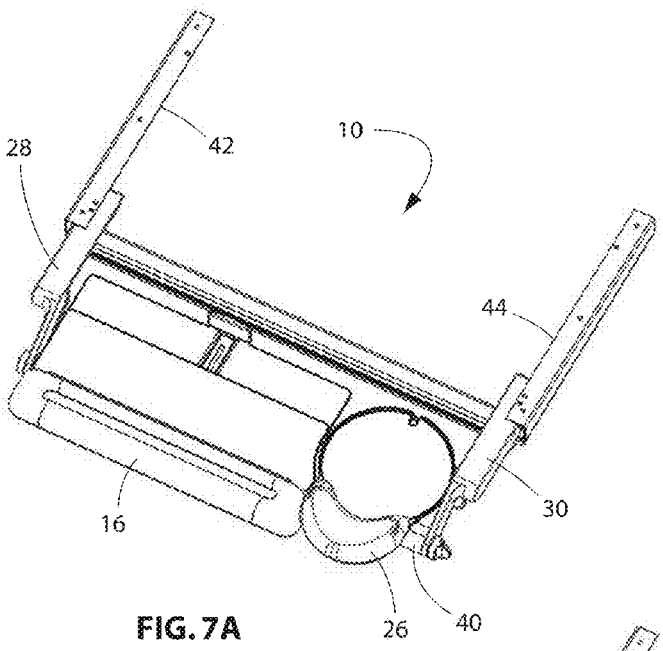
FIGS. 7A and 7B are upper perspective views of the ergonomic keyboard, mouse, and wrist support with the mouse support adjusted between lower and upper supportive positions.
Figure 7B:
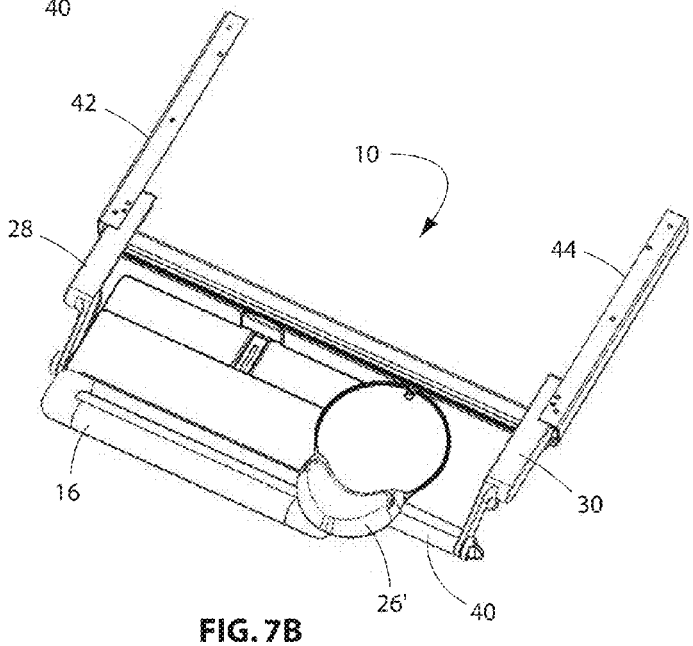

Alternatively, as shown most clearly in FIG. 6, the mouse support plate 24 could be selectively adjusted in vertical and, possibly, lateral position relative to the remainder of the support arrangement 10. As FIG. 6 shows, there can be a lower position of the mouse support plate 24 and the mouse wrist support 26 where the mouse support plate 24 is generally coplanar with the first and second keyboard support plates 12 and 14 and where the mouse wrist support 26 is at a generally equal level to the keyboard wrist support 16. While in a lower position, the mouse support plate 24 is side by side with the keyboard support plates 12 and 14 and the mouse wrist support 26 is side by side with the keyboard wrist support 16. There can be a raised position of the mouse support plate 24' and the mouse wrist support 26' where the mouse support plate 24' is above and partially overlapping with the keyboard support plates 12 and 14 and the mouse wrist support 26' is above and partially overlapping the keyboard wrist support 16. With this, the relative height and lateral position of the mouse support plate 24 and the mouse wrist support 26 can be adjusted and varied selectively.

Figure 3:
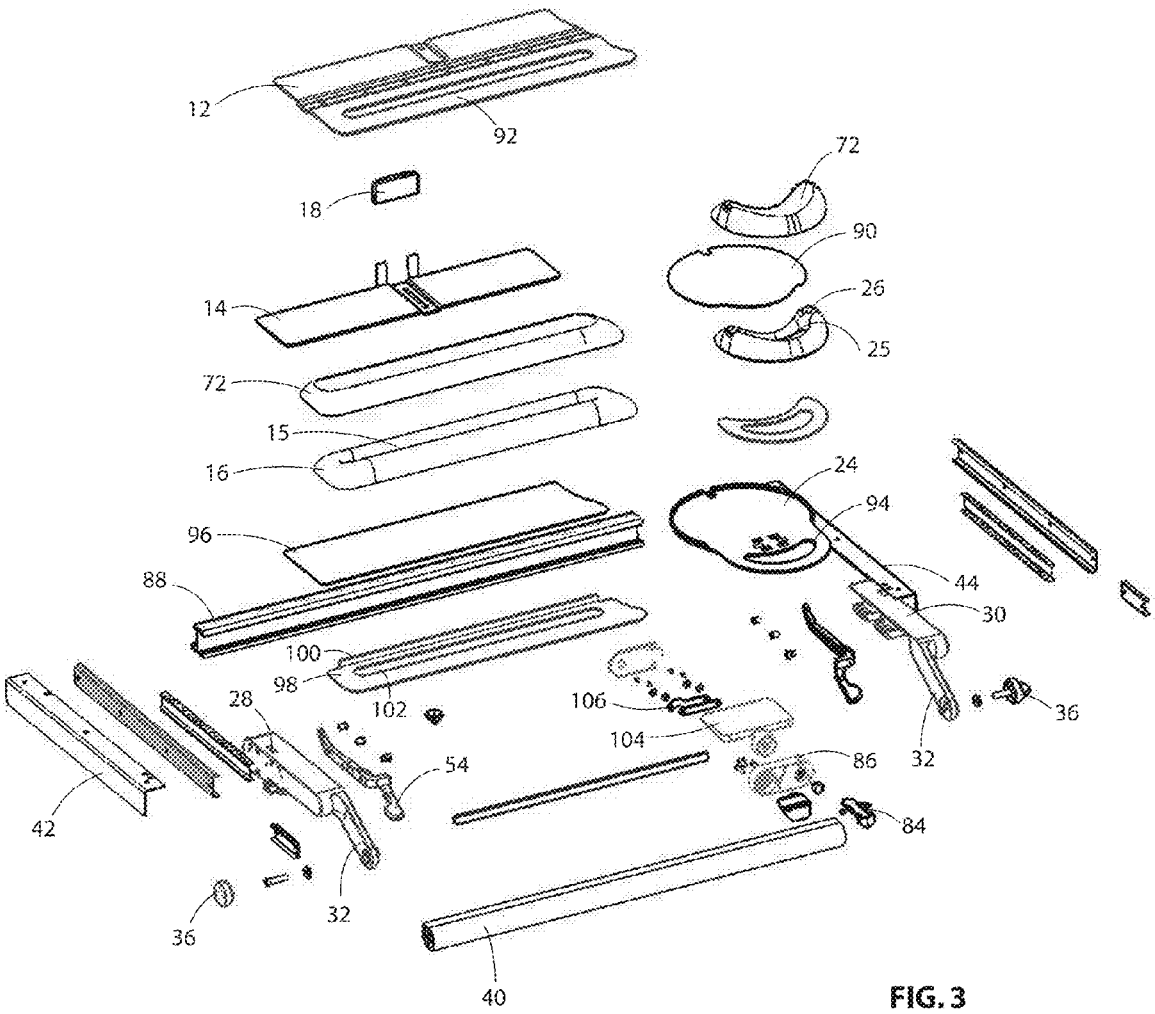
FIG. 3 is an exploded perspective view of the adjustable ergonomic keyboard, mouse, and wrist support of FIG. 1.

One skilled in the art might be able to conceive of a number of mechanisms for accomplishing such movement of the mouse support plate 24 and the mouse wrist support 26. As can be appreciated by combined reference to FIGS. 2 through 6 and FIGS. 7A and 7B, the depicted embodiment accomplishes the vertical and lateral movement by a pivotable arm 86 that is actuated by a slide action locking tooth 84, 84' to enable the mouse support plate 24 and the mouse wrist support 26 to be raised and moved laterally inwardly and lowered to be moved laterally outwardly. A pivoting of the pivotable arm 86 can be selectively permitted by actuation of the slide action locking tooth 84. The pivotable arm 86 has a first end pivotally retained relative to the transverse member 40 and a second end pivotally coupled to a support plate 104 to which the mouse support plate 24 is fixed. Parallel movement arms 106, which are shown in FIG. 3, within the pivotable arm 86 induce a parallel movement of the support plate 104 and thus the mouse support plate 24 and the mouse wrist support 26 as is best shown in FIG. 3. With this, the mouse support plate 24 will be retained in a desired disposition even as it is pivoted between upper and lower positions.

The support arrangement 10 can be disposed in an extended disposition for enabling use of the retained keyboard 400 and mouse 408 and can be disposed in a retracted disposition during periods of non-use. As can be best perceived by reference to FIGS. 1 through 4B, the support arrangement 10 can be selectively locked in its extended disposition by operation of locking levers 54 that are retained to pivot about pivot axes 112 relative to the elongate rails 28 and 30. Each locking lever 54 has a locking tip 114 disposed at the distal end thereof that can be selectively received into outer locking apertures 56A in the slide rails 42 and 44 to lock the support arrangement 10 in an extended, use disposition and into inner locking apertures 56B in the slide rails 42 and 44 to lock the support arrangement 10 in a refracted, storage disposition. Each locking lever 54 can have a handle portion at the proximal end thereof projecting below the arms 32.

Figure 4B:
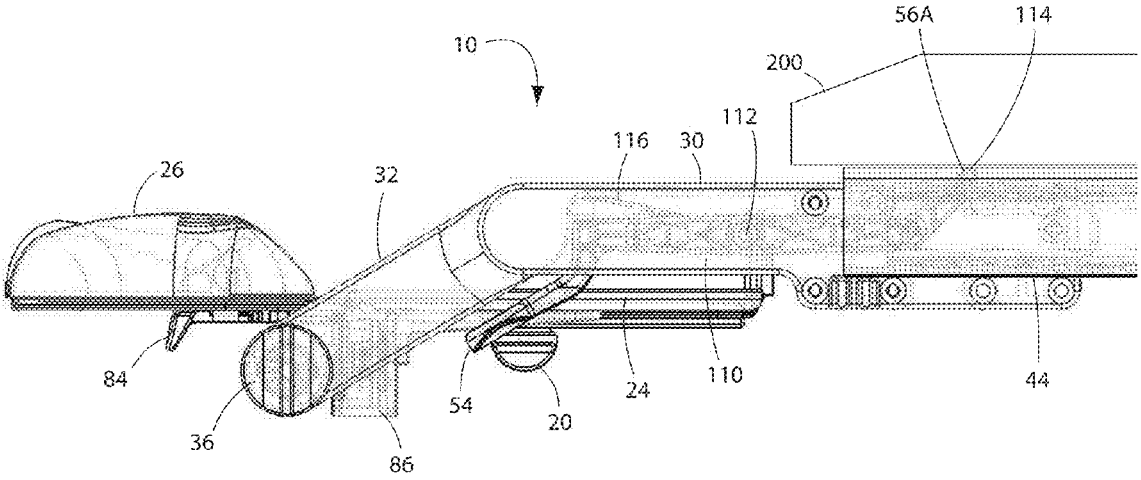
FIG. 4B is a partially sectioned view in side elevation of a portion of the adjustable ergonomic keyboard, mouse, and wrist support mounted to a support surface.

Biasing springs 116 can bias the locking levers 54 to a locked position with the locking tip 114 engaged with an aperture 56A or 56B. A variety of locking springs 116 would be possible within the scope of the invention. In the presently contemplated embodiment, the locking springs 116 each comprise a deflectable arm that has a proximal end fixed to the upper surface of the locking lever 54 to the outer side of the pivot axis 112 and a body portion interposed between the lever 54 and a downwardly facing surface of the elongate rail 28 or 30. In this example, as best seen in FIG. 4B, except for the handle portion, the locking levers 54 are disposed within an open inner volume within the elongate rail 28 or 30.

Under this arrangement, starting with the support arrangement 10 in a retracted disposition, use of the arrangement 10 can begin with a user's actuating the locking levers 54 by pressing upwardly on the proximal handle portions thereof. With this, the locking tips 114 will be disengaged from the inner locking apertures 56B and the first and second elongate rails 28 and 30 can be slid outwardly along the slide rails 42 and 44 and thus outwardly in relation to the support surface 200. Once the outer locking apertures 56A are reached, the locking tips 114 will automatically engage therewith thereby locking the support arrangement 10 in an extended disposition.

Figure 5A:
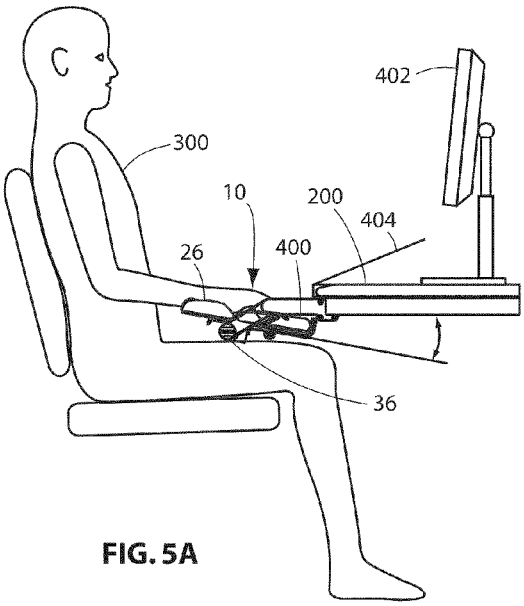
FIGS. 5A and 5B are views in side elevation of an embodiment of the ergonomic keyboard, mouse, and wrist support in use.
Figure 5B:
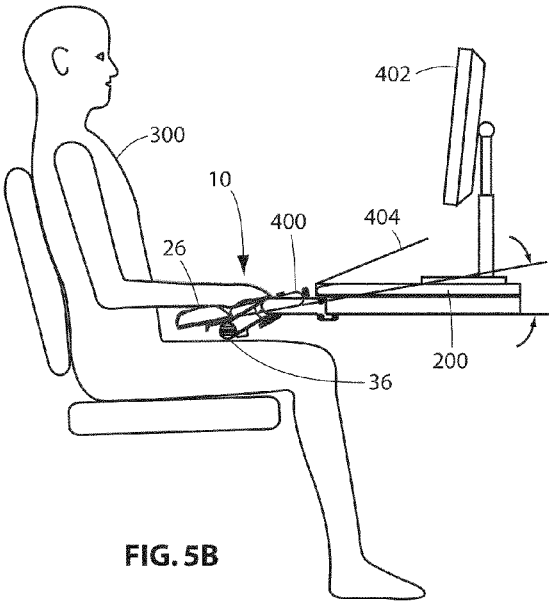

The keyboard support plates 12 and 14 and the mouse support plate 24 can then be selectively pivoted to the ergonomic comfort of the user. For example, as shown in FIG. 5A, the keyboard support plates 12 and 14 and the mouse support plate 24 can be pivoted to a negative tilt through an angle $\alpha$ by an actuation of the angular adjustment knobs 36. As shown in FIG. 5B, the keyboard support plates 12 and 14 and the mouse support plate 24 can be pivoted to a positive tilt through an angle $\beta$ again by an actuation of the adjustment knobs 36. As shown in FIG. 3, the angular adjustment knobs 36 can be fixed at given angular dispositions by a positive engagement between the knobs 36 and the distal ends of the arms 32, in this case by radial ridges on the inner surfaces of the knobs 36 and the outer surfaces of the distal ends of the arms 32.

The keyboard wrist support 16 and the mouse wrist support 26 can be formed as ergonomically configured members with a peripheral ridge or wall and an open inner area. The keyboard wrist support 16 can be an elongate, generally rectangular member with an arcuate upper cross section and a flat lower surface. The mouse wrist support 26 can be crescent shaped. The keyboard wrist support 16 can have a generally rectangular through aperture 15, which in this example traverses from adjacent to the first end to adjacent to the second end of the keyboard wrist support 16. Similarly, the mouse wrist support 26 can have a through aperture 25 that is also crescent shaped. With this, the body portions of the keyboard wrist support 16 and the mouse wrist support 26 and the apertures 15 and 25 can generally mirror each other in shape.

As shown in FIG. 3, the wrist support plate 98 has an aperture 102 therein that matches the aperture 15 in the keyboard wrist support 16. Likewise, the first keyboard support plate 12 has an aperture 92 therein that matches the shape and size of the apertures 15 and 102. When the keyboard wrist support 16 is retained relative to the wrist support plate 98 and both are fixed to the first keyboard support plate 12, the apertures 15, 92, and 102 are disposed to align. Likewise, the mouse support plate 24 has an aperture 94 therein that matches the shape and size of the aperture 25 in the mouse wrist support 26. When the mouse wrist support 26 is retained relative to the mouse support plate 24, the apertures 25 and 94 align. With this, as can be seen in FIG. 8A relative to the keyboard wrist support 16, air can flow through the open apertures to prevent overheating and discomfort as the user's hand 302 rests on the keyboard wrist support 16.

The supports 16 and 26 can be formed from resiliently compressible material which, in certain embodiments, can comprise a shape memory material or self-skinned polyurethane foam of a very low durometer for optimizing user comfort. The supports 16 and 26 can be gel-like in performance or formed with a gel interior. The mouse and keyboard wrist supports 26 and 16 can have different durometers to accommodate their different uses. As shown in FIG. 8A, the supports 16 and 26 can be applied, such as by molding, to contoured frames 78, which can be retained by fasteners 82 to the plate 12 in relation to the keyboard wrist support 16 and to the plate 24 in relation to the mouse wrist support 26.

Figure 9:
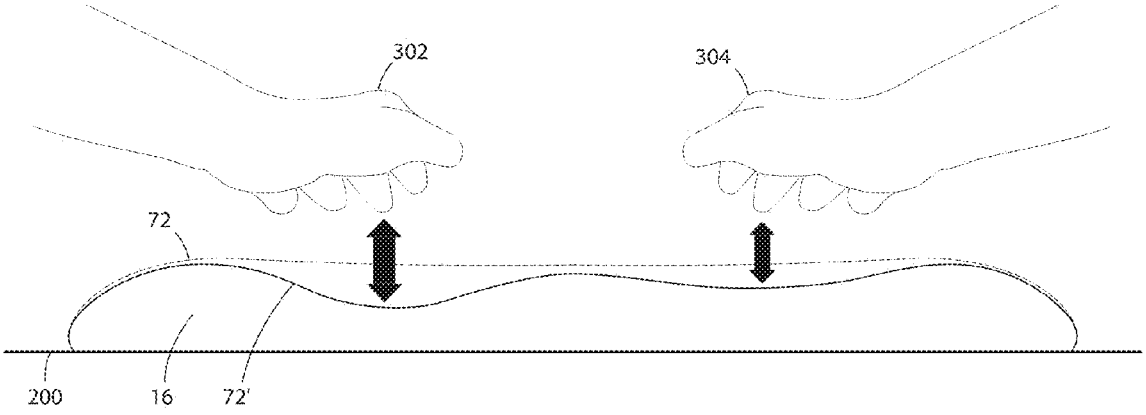
FIG. 9 is a schematic view in rear elevation of a keyboard wrist support as disclosed herein.

As FIGS. 3 and 8A through 8C show, one or more layers of material 72 and 74, such as elastomeric material, can be stretched over the keyboard wrist support 16 and the mouse wrist support 26. The elastomeric material can be a multi-stretch elastomeric mesh material with a soft, moisture absorbent surface. In certain embodiments, the material can be anti-bacterial to optimize hygiene. By providing the open inner area with or without through apertures, the supports 16 and 26 provide an air zone to facilitate dryness and comfort. By use of contoured supports 16 and 26 and select layers of material 72 and 74, the layers of material 72 and 74 and the supports 16 and 26 can conform and provide comfortable support to the compressing object, such as the user's wrist or hand 302. Just as importantly, as FIG. 9 shows most clearly, individualized support can be provided to each of the user's hands 302 and 304 depending, for example, on the disposition and force applied by the hands 302 and 304.

Figure 20A:
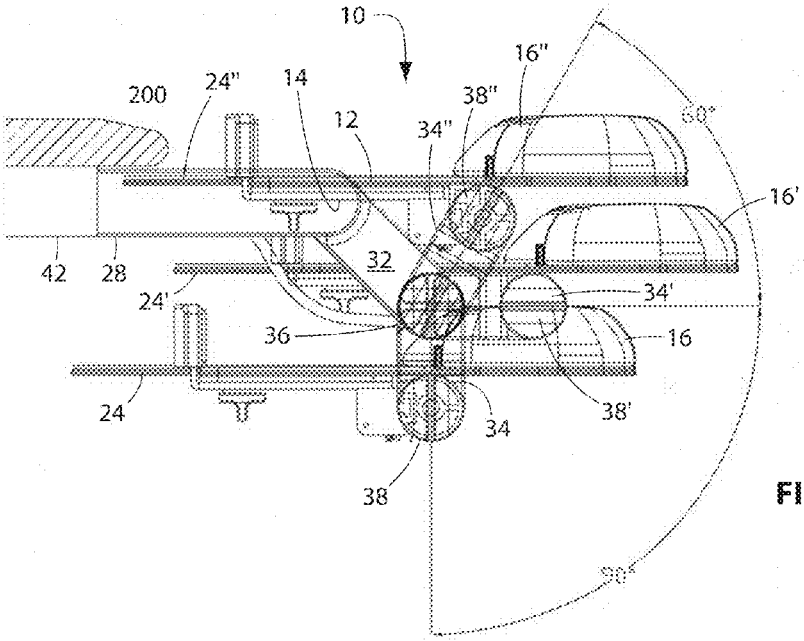
FIG. 20 is a view in side elevation of a mouse support according to the embodiment of FIG. 17 in varied positions.
Figure 20B:
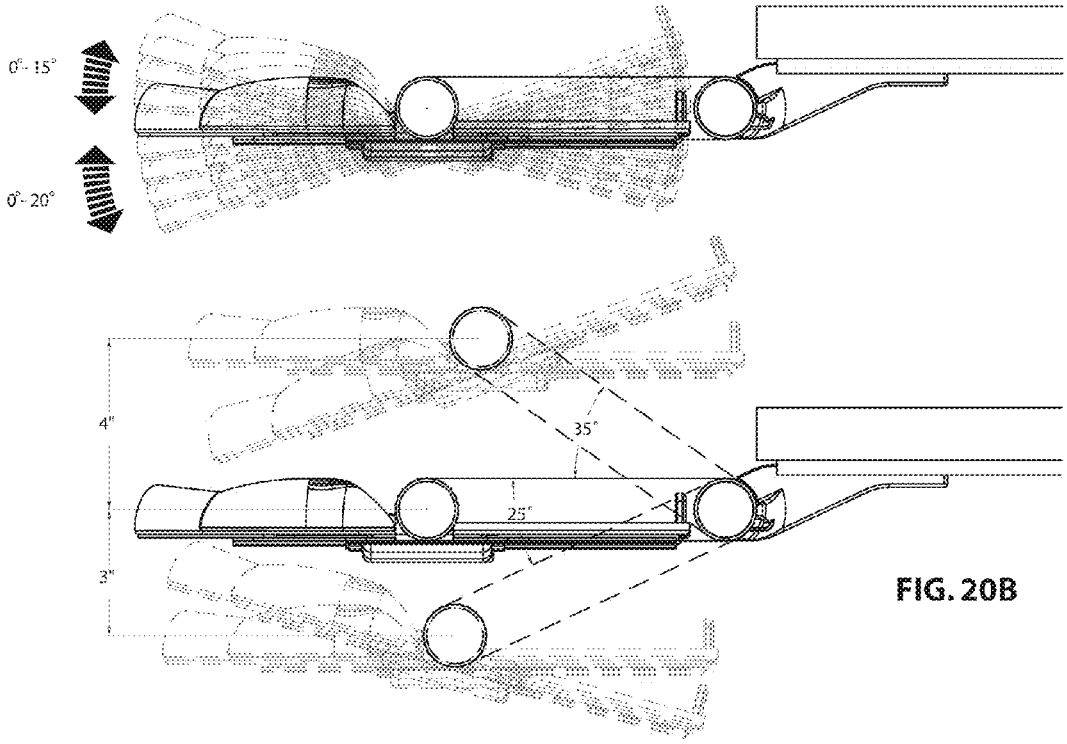
Figure 21A:
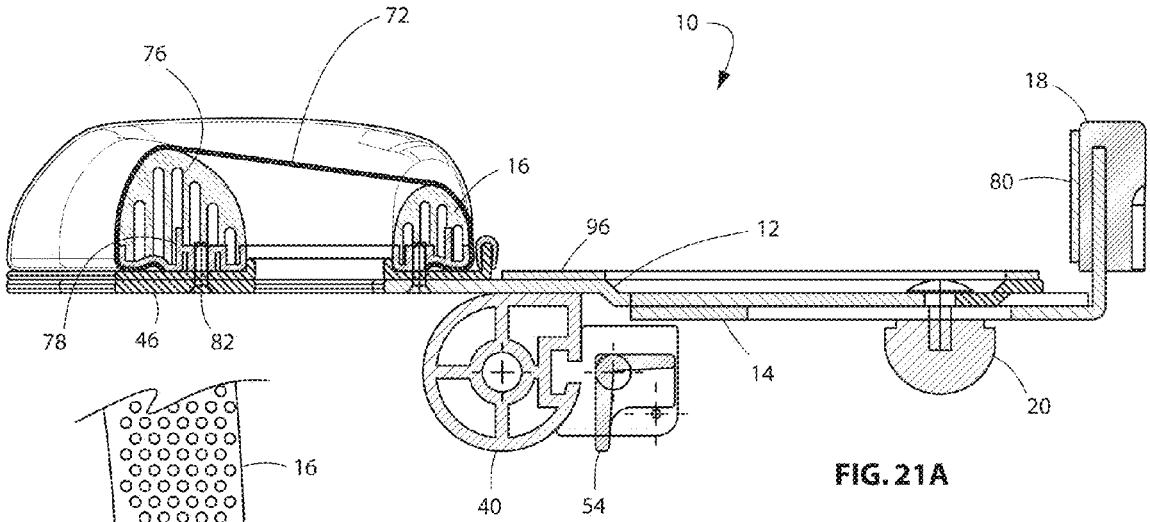
FIG. 21A is a cross sectional view of an alternative wrist support as taught herein.
Figure 21B:
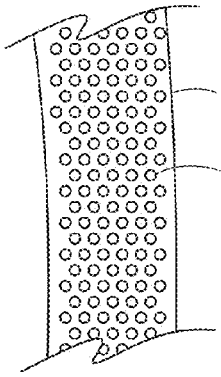
FIG. 21B is a bottom plan view of the keyboard wrist support of FIG. 21A.

As FIGS. 21A and 21B depict in relation to the embodiment of FIGS. 17 through 20, vertical cavities 76 can be disposed in the supports 16 and 26. The cavities 76 can enable a plurality of advantages. For example, the cavities 76 can improve breathability and dissipate heat. They can also allow for unique and adaptable performance and compression characteristics of the supports 16 and 26 by the selective positioning of the cavities 76.

As shown in the embodiment of the support arrangement 10 of FIG. 10, an edge-mounted document holder 404 can additionally be included for retaining documents for the user. The document holder 404 can have a channel in the lower end thereof for slidably engaging the outer edge of the support surface 200, which could be a desk, counter, or any other support surface. As is also shown in FIG. 10, the keyboard wrist support 16 could have a retention tray 118 formed within the aperture 15 therein, such as by a panel of breathable material retained at the bottom of the keyboard wrist support 16. With this, the retention tray 118 formed by the inner edges of the wall of the keyboard wrist support 16 can be used for retaining writing utensils and other items.

Figure 11:
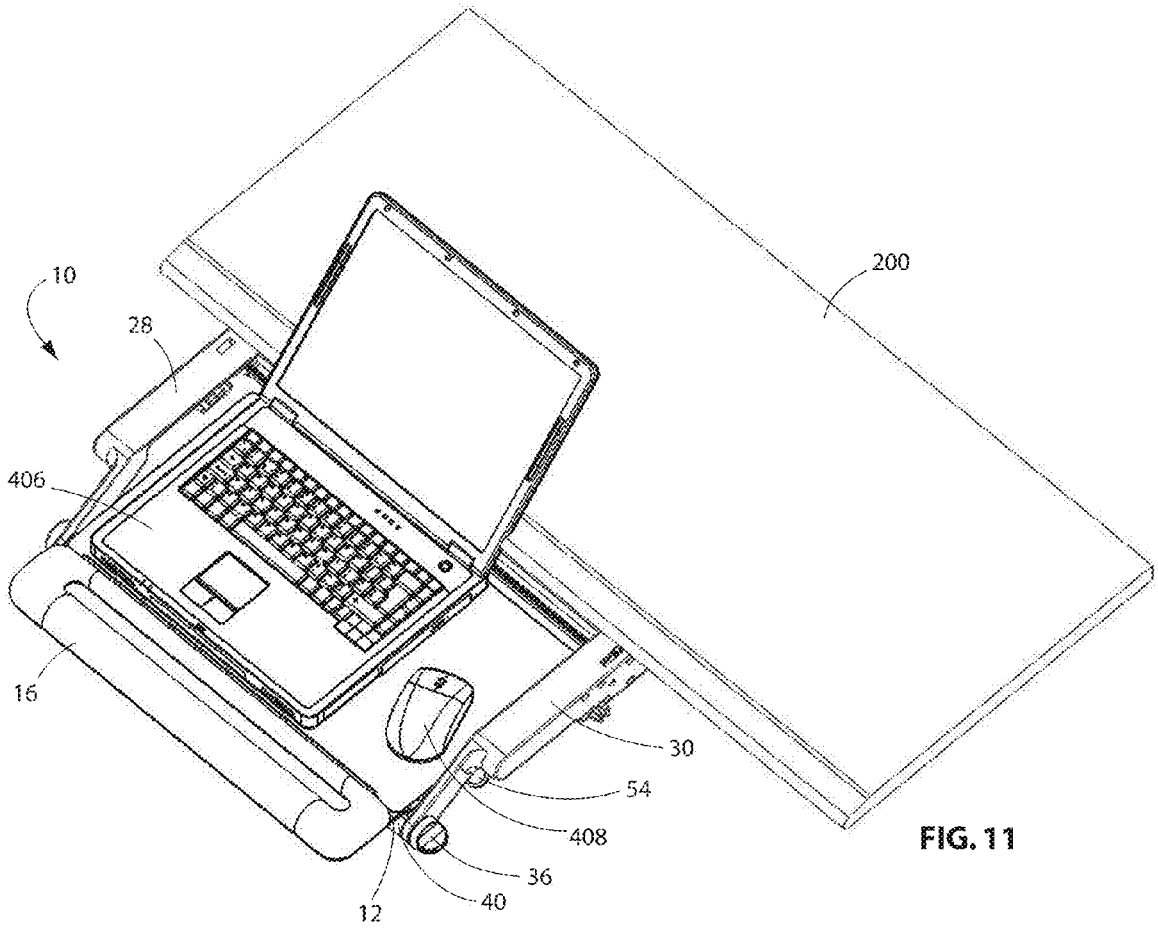
FIG. 11 is an upper perspective view of another alternative embodiment of the ergonomic keyboard, mouse, and wrist support disclosed herein.
Figure 12:
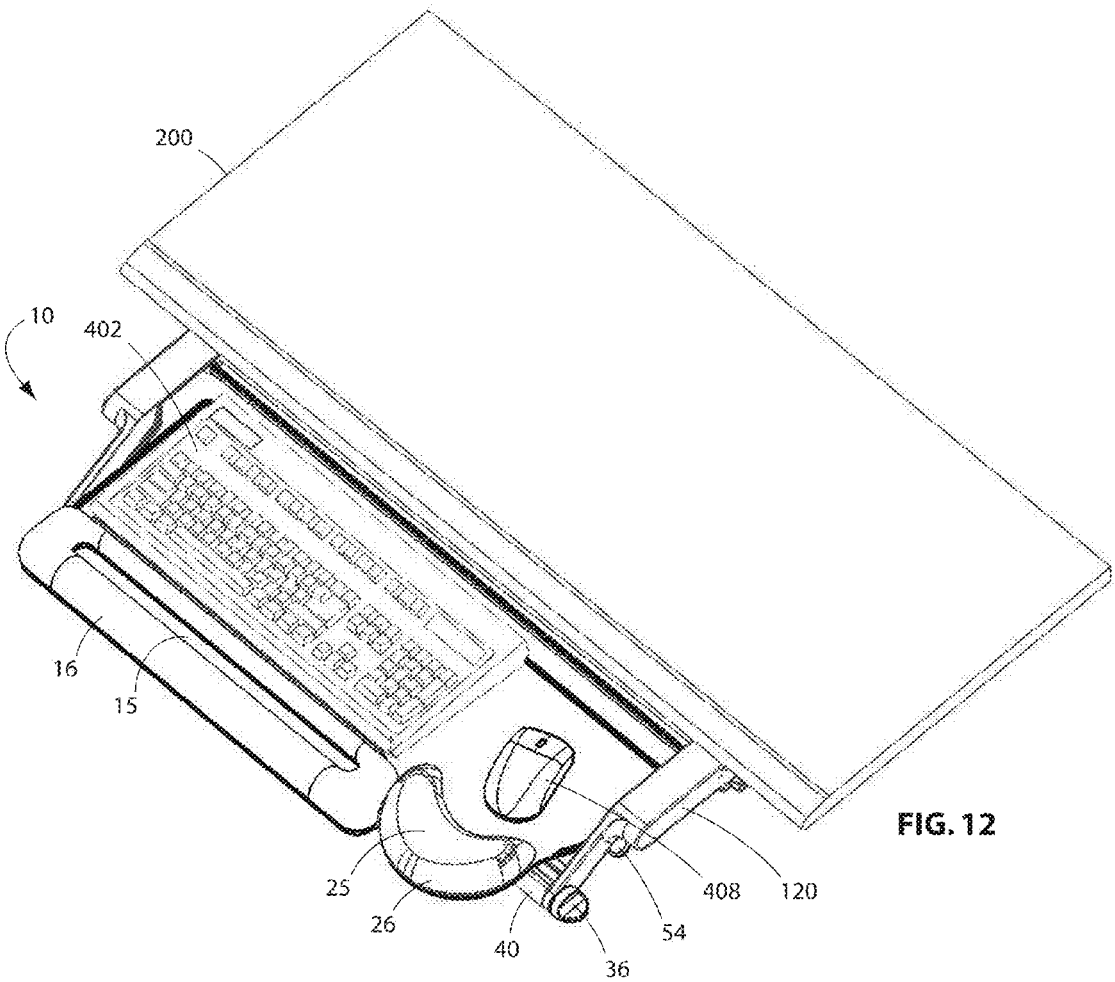
FIG. 12 is an upper perspective view of a further embodiment of the ergonomic keyboard, mouse, and wrist support disclosed herein.
Figure 13:
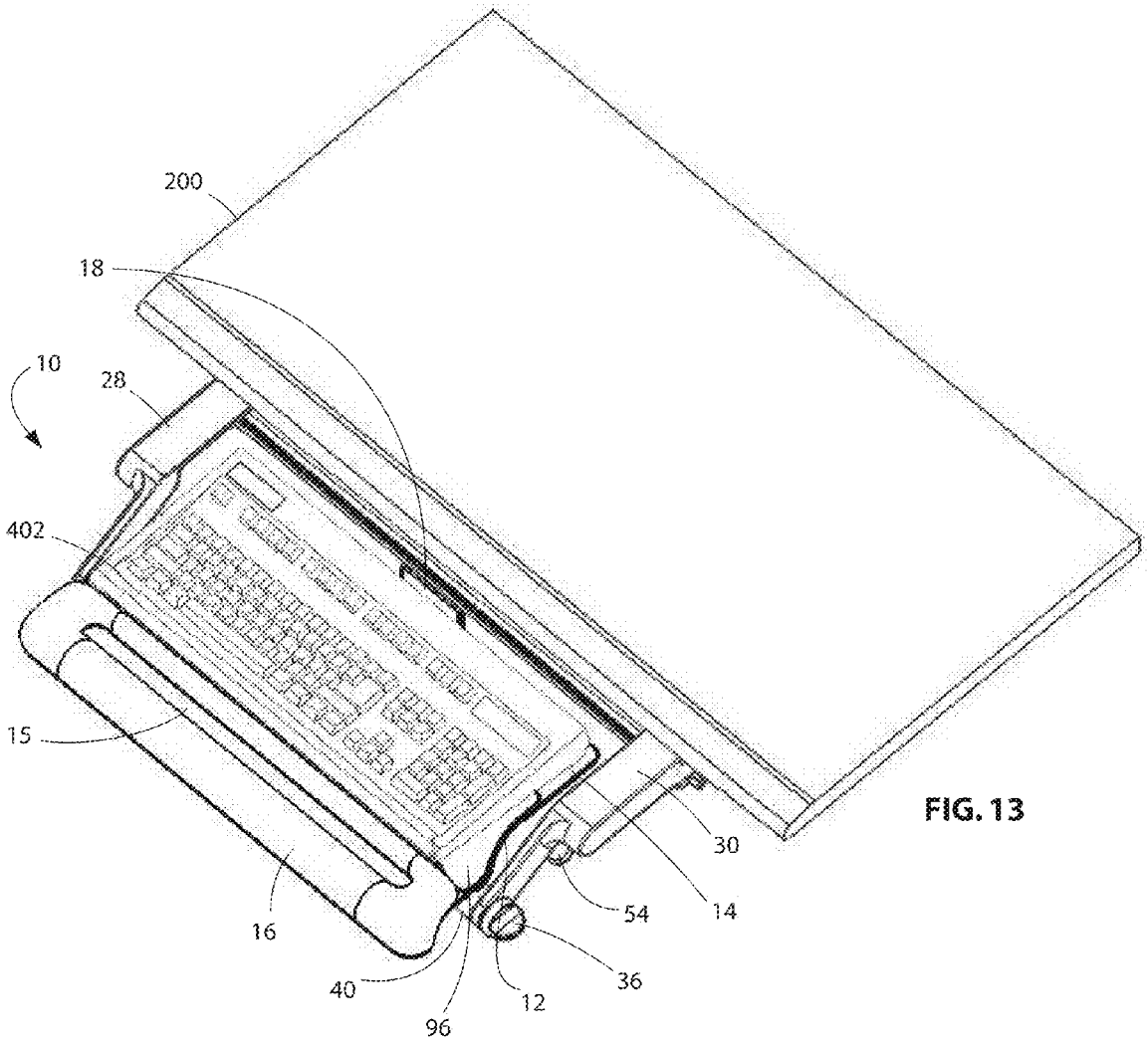
FIG. 13 is an upper perspective view of an ergonomic keyboard and wrist support disclosed herein.

As shown in FIG. 12, embodiments are contemplated wherein a single support plate 120 can be employed for retaining the keyboard 400, the mouse 408, the keyboard wrist support 16, and the mouse wrist support 26. Again, the support plate 120 is pivotable about a laterally disposed pivot axis by operation of the adjustment knobs 36. Even further embodiments are contemplated as in FIG. 11 wherein a single keyboard support plate 12 is pivotally retained to retain a laptop 406 and a mouse 408. Also, as in FIG. 13, it is possible to have first and second keyboard support plates 12 and 14 employed to retain only a keyboard 400 together with a keyboard wrist support 16.

Figure 14:
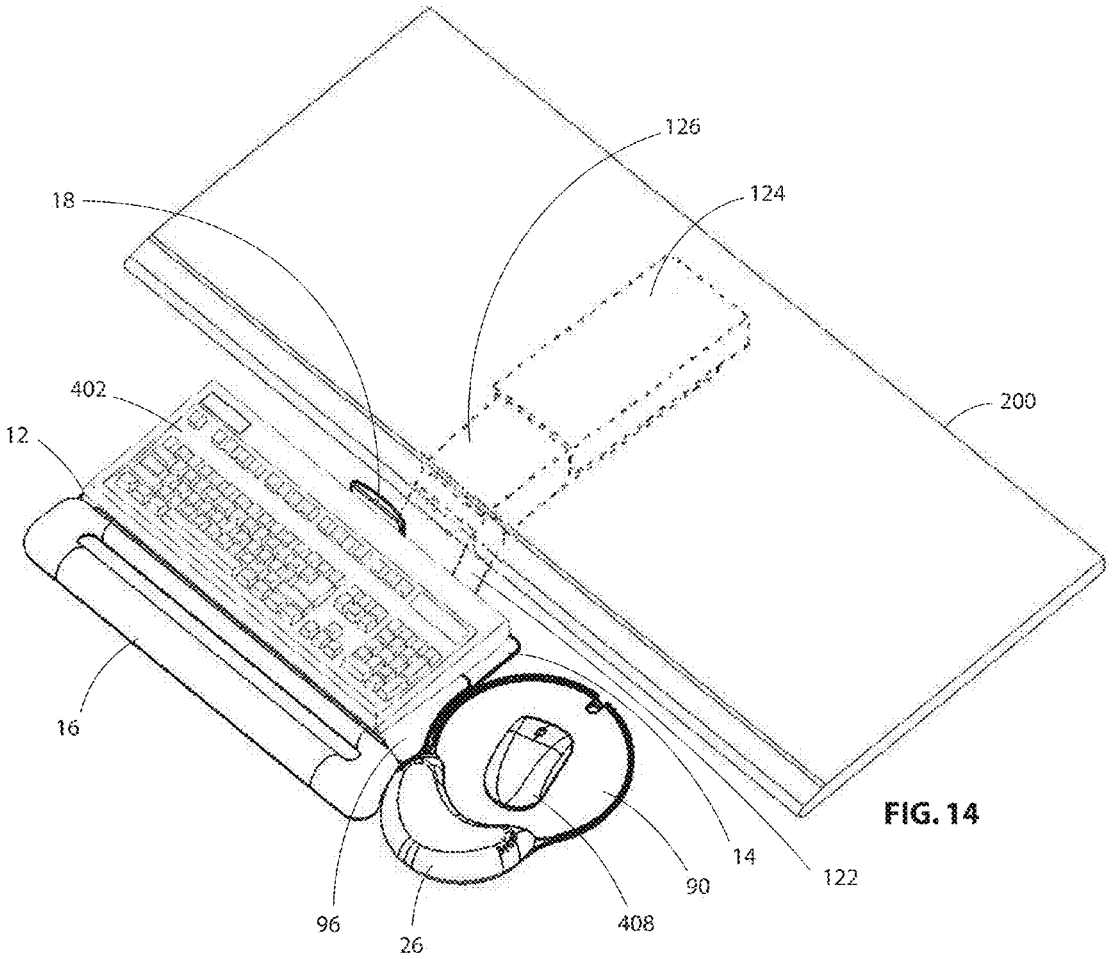
FIG. 14 is an upper perspective view of an additional embodiment of the ergonomic keyboard, mouse, and wrist support disclosed herein.

As shown in FIG. 14, the first and second rails 28 and 30 and the slide rails 42 and 44 can be replaced by a single elongate rail 126 that is slidably retained relative to a single slide channel 124. A pivoting arm 122, which can be a parallel movement arm, can have a proximal end pivotally coupled to the distal end of the elongate rail 126 and a distal end pivotally coupled to, for example, a transverse member (not shown) or directly to the first or second support plates 12 or 14. A keyboard friction pad 96 can help retain the keyboard in a fixed position.

Figure 15:
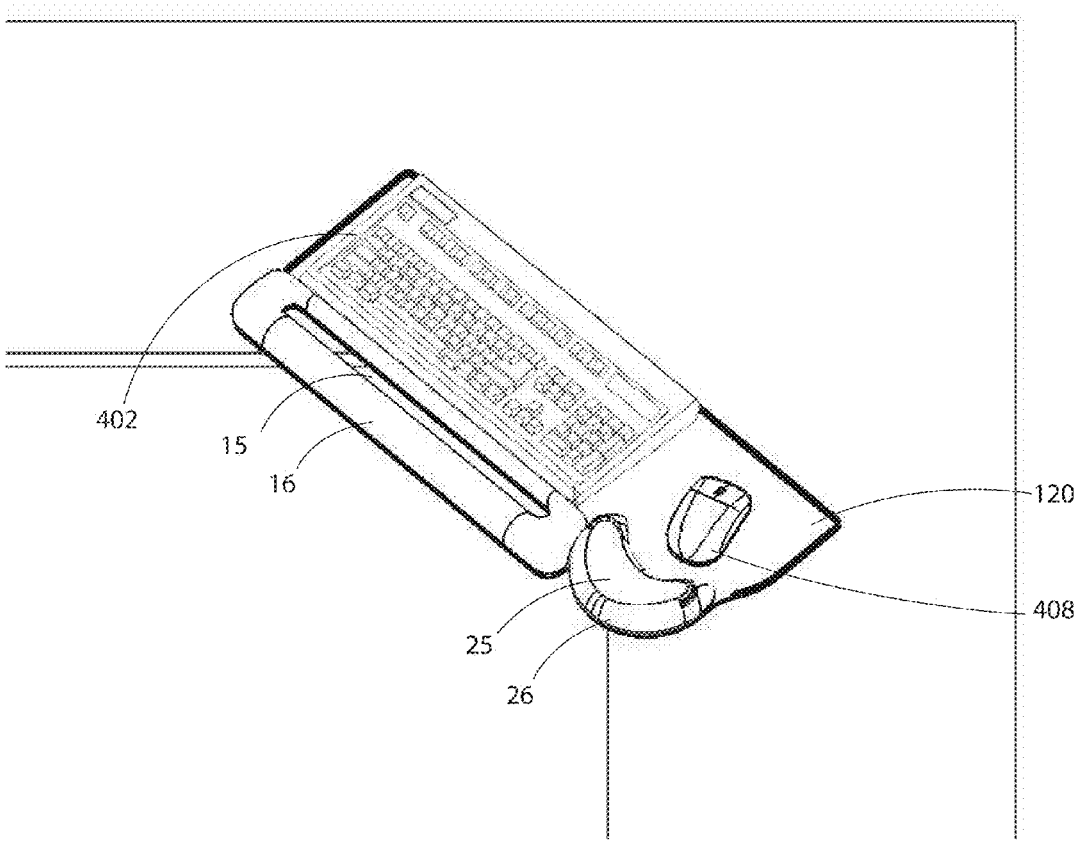
FIG. 15 is an upper perspective view of an even further embodiment of the ergonomic keyboard, mouse, and wrist support disclosed herein.
Figure 16:
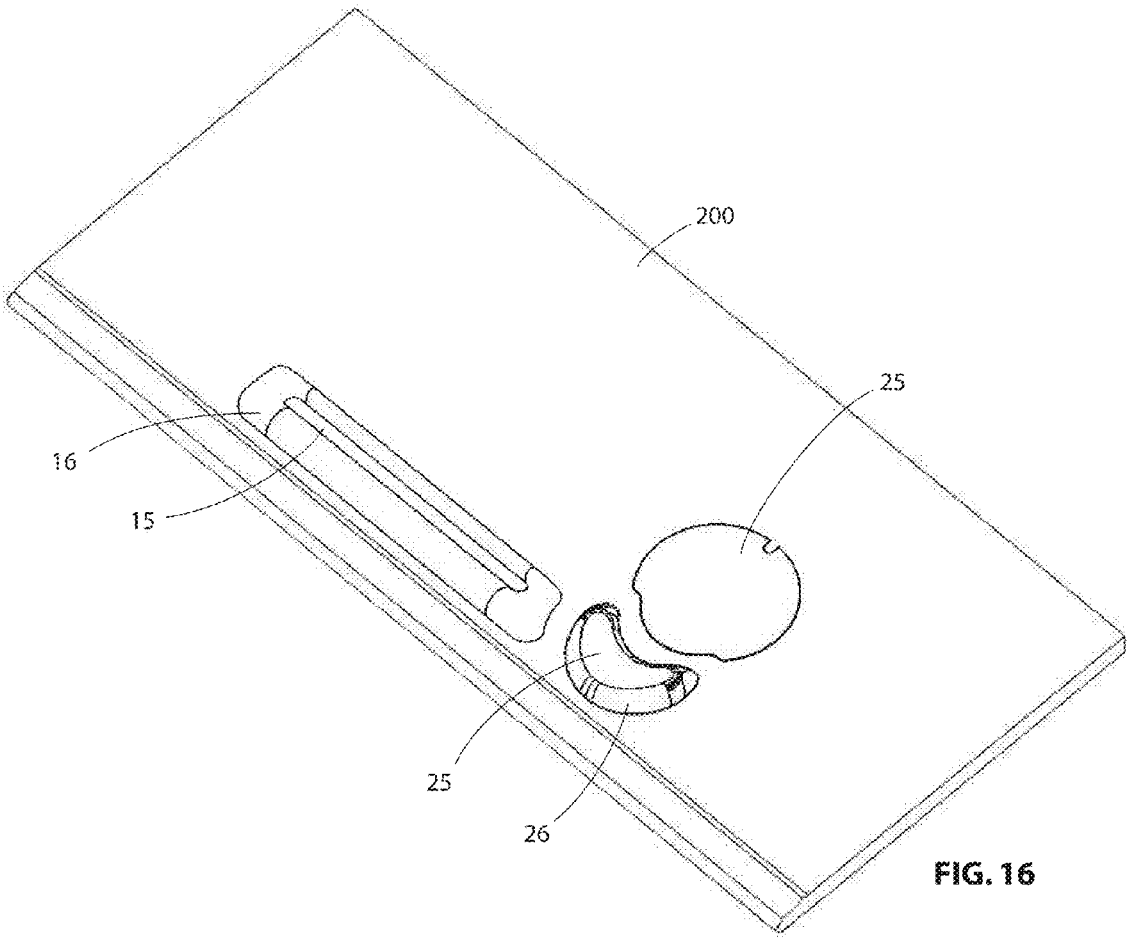
FIG. 16 is an upper perspective view of a keyboard and mouse wrist support as disclosed herein.
Figure 17:
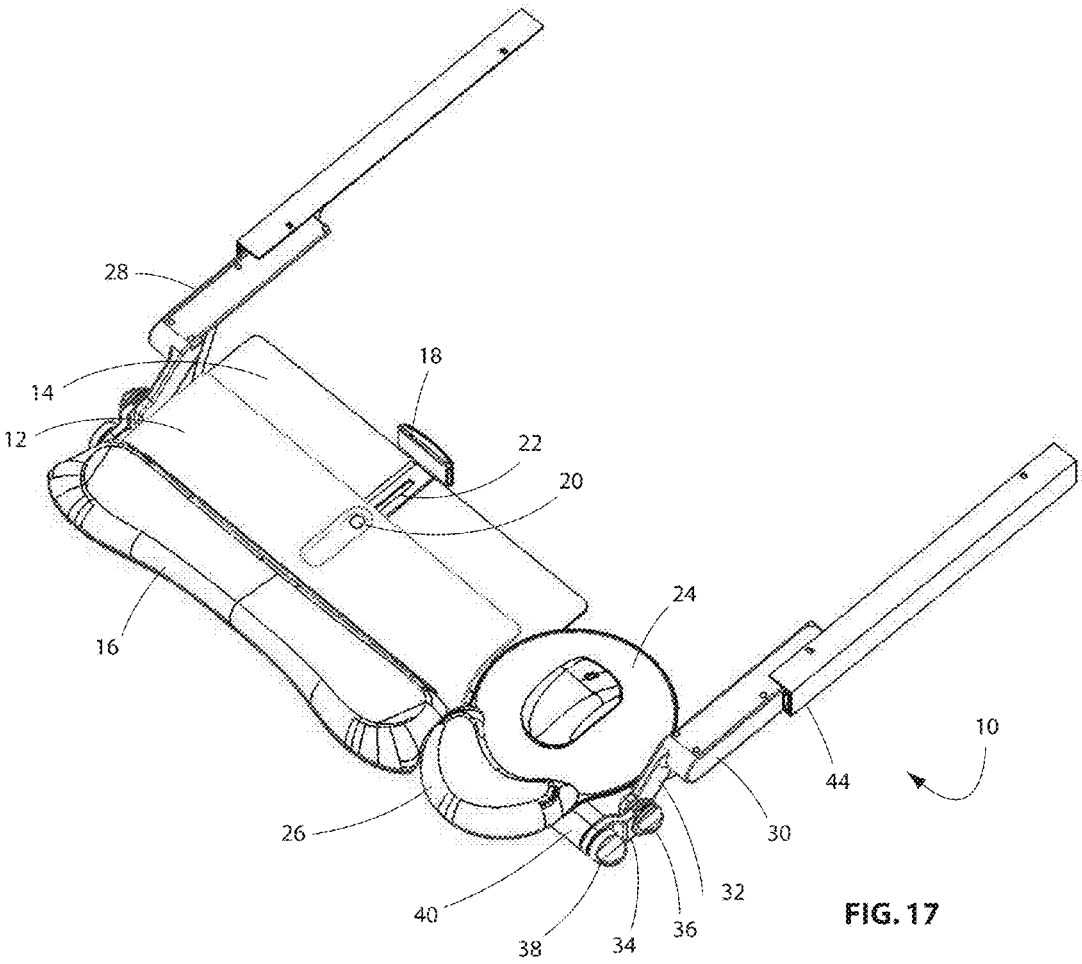
FIG. 17 is an upper perspective view of another embodiment of the ergonomic keyboard, mouse, and wrist support disclosed herein.
Figure 18:
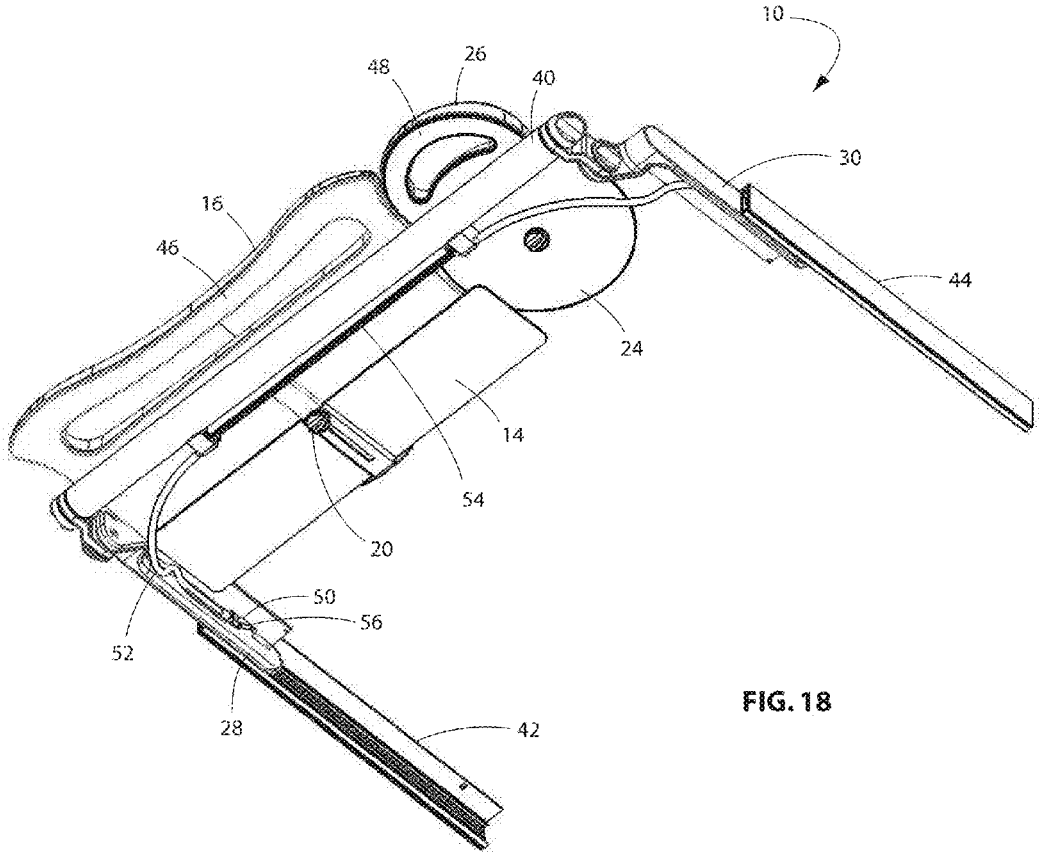
FIG. 18 is a lower perspective view of the ergonomic keyboard, mouse, and wrist support of FIG. 17.
Figure 19:
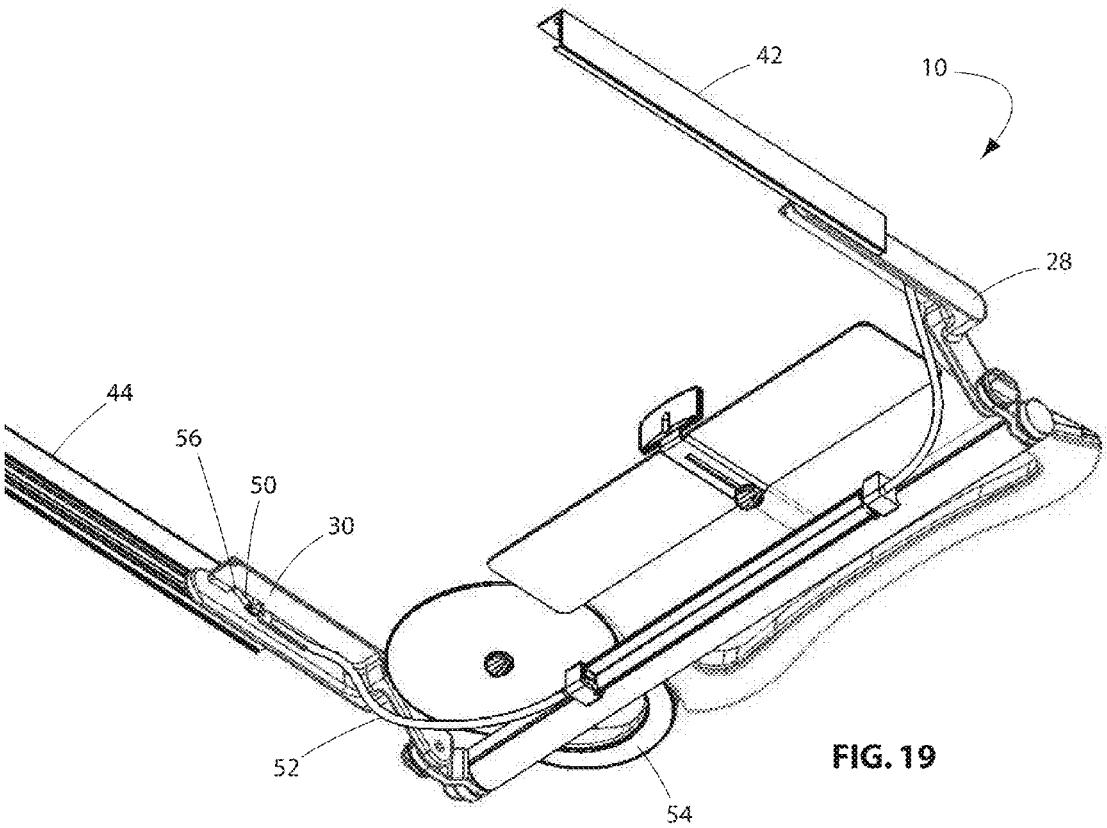
FIG. 19 is an alternative lower perspective view of the ergonomic keyboard, mouse, and wrist support of FIG. 17.

In an even further embodiment shown in FIG. 15, a unitary support plate 120 can be employed to retain a keyboard 400, mouse 408, or other items. A keyboard wrist support 16 and a mouse wrist support 26 as disclosed herein can be retained relative to the unitary support plate 120. With this, the arrangement could be used independently of any extension and refraction mechanisms. For example, as shown in FIG. 15, the arrangement could be disposed relative to a support surface, such as bridging the corner thereof. As shown in FIG. 16, it is possible to enjoy benefits of the invention simply by use of a separate keyboard wrist support 16 and a separate mouse wrist support 26 as disclosed herein. A mousepad 24 can retain a mouse (not shown).

An alternative support arrangement 10 is shown in FIGS. 17 through 21B. The support arrangement has a transverse member 40 with first and second ends pivotally coupled to distal ends of distal arms 34 at distal pivot axes 38. The proximal ends of the distal arms 34 are pivotally coupled to distal ends of proximal arms 32 at proximal pivot axes 36. The proximal arms 32 are fixed at a downward angle relative to distal ends of first and second opposed elongate rails 28 and 30. The elongate rails 28 and 30 are slidably retained by first and second slide rails 42 and 44 by any appropriate means including, for example, a ball bearing arrangement to ensure smooth sliding characteristics. The first and second slide rails 42 and 44 can be fixed to an external support surface 200, such as a desktop or countertop.

Figure 38:
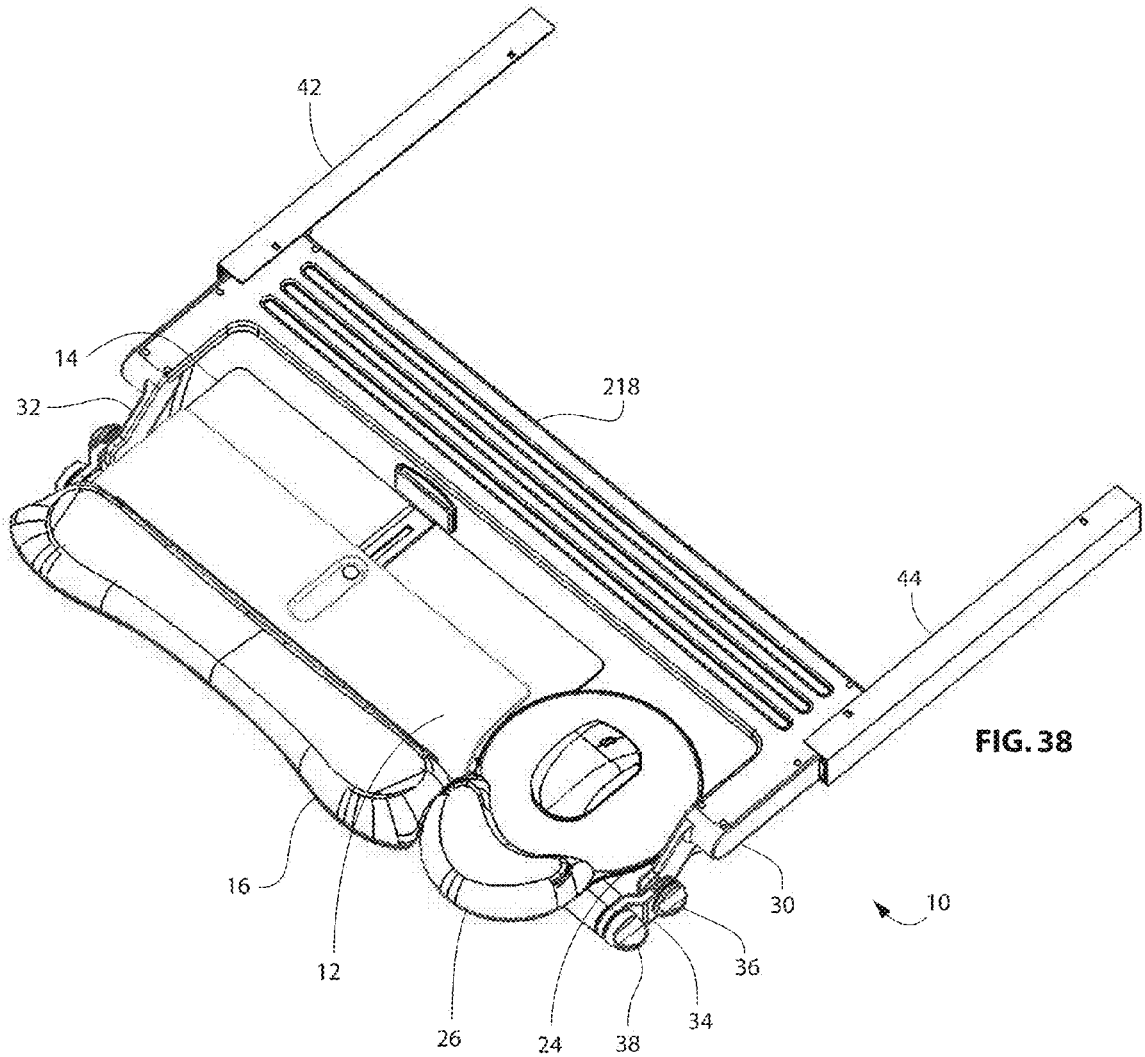
FIG. 38 is an upper perspective view of a support arrangement with a central plate.
Figure 39:
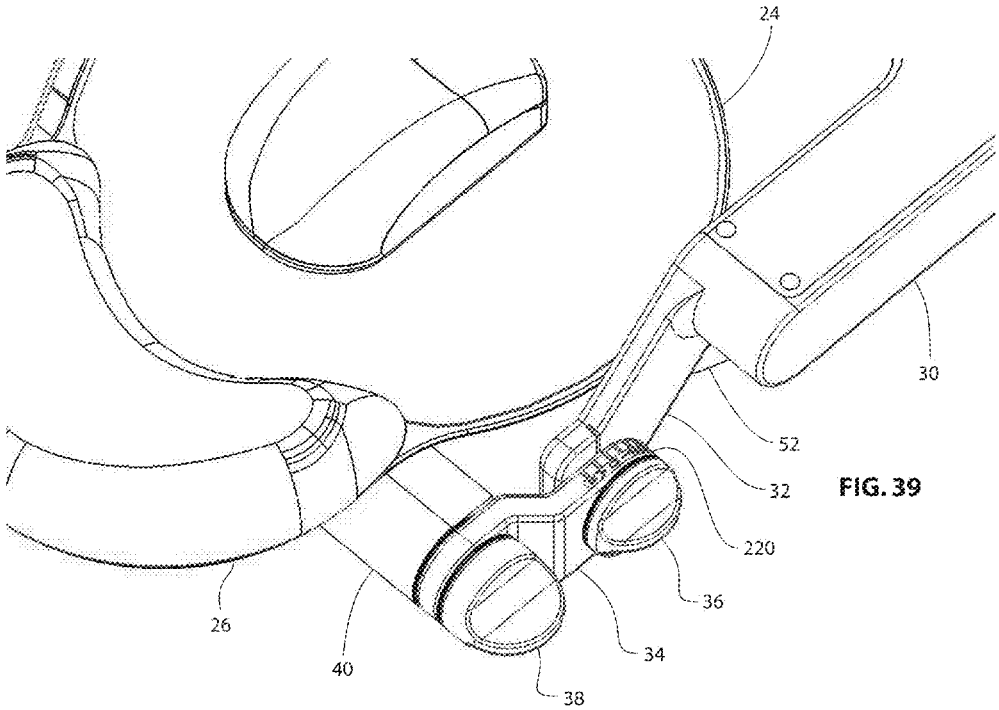
FIG. 39 is a close-up perspective view of a height adjustment portion of the support arrangement of FIG. 38.

As is shown in FIG. 38, embodiments are additionally contemplated wherein the stabilizing cross support 88 is replaced by a stamped plate 218 that is fixed to, or integrally formed with, the first and second rails 28 and 30 thereby to span between the rails 28 and 30 to provide stabilization and the like to the support arrangement 10. Looking to FIG. 39, angular position markings 220 can be disposed on one or both distal arms 34 to enable a user to ensure a desired adjustment of the angle of the arms 34 and the height and relative position of supported components.

A first keyboard support plate 12 is retained relative to the transverse member 40 for movement therewith. A second keyboard support plate 14 is slidably engaged with the first keyboard support plate 12 by a sliding engagement between a slot 22 in the second keyboard support plate 14 and a fastener 20 passing through the first keyboard support plate 12 and the slot 20. Together, the first and second keyboard support plates 12 and 14 form a keyboard platform. An upstanding clamping member 18 is fixed relative to an inner edge of the second keyboard support plate 14, and a raised keyboard wrist support 16 is retained toward or relative to an outer portion of the first keyboard support plate 12. With this, a keyboard (not shown) can be placed atop the keyboard platform formed by the first and second keyboard support plates 12 and 14 and then effectively clamped in place by a sliding of the second keyboard support plate 14 toward the first keyboard support plate 12 such that the keyboard is frictionally retained by the inboard surface of the clamping member 18 and the inboard surface of the keyboard wrist support 16. A friction pad 80 can be disposed on the inboard surface of the clamping member 18 as shown in FIG. 21A to ensure a most secure retention of the keyboard.

A mouse support plate 24, which can be separate from or integral with one of the keyboard support plates 12 or 14 is also retained relative to the transverse member 40. A mouse wrist support 26 can be retained relative to an outer portion of the mouse support plate 24. With this, a mouse (not shown) can be disposed atop the mouse support plate 24 and the wrist and hand of the user (not shown) can enjoy support from the mouse wrist support 26.

The support arrangement 10 can be disposed in an extended disposition for enabling use of the retained keyboard and mouse and can be disposed in a retracted disposition during periods of non-use. The support arrangement 10 can be selectively locked in its extended disposition by an engagement of a latch 50 pivotally retained relative to the elongate rails 28 and 30 with one or more apertures 56 disposed along the first and second slide rails 42 and 44. The operation of the latch 50 can be controlled by a control wire 52 in combination with a control lever 54. Under this arrangement, a user can slide the support arrangement 10 to a desired extended position to cause the tip of the latch or latches 50 to engage the aperture or apertures 56. When the support arrangement 10 is to be retracted, the control lever 54 can be actuated, such as by squeezing, to cause the latches 50 to disengage from the apertures 56 to enable free sliding of the elongate rails 28 and 30.

By use of the proximal pivot axis 36 and the distal arms 34, the keyboard support plates 12 and 14 and the mouse support plate 24 can be adjusted in height and position relative to the user. Furthermore, by use of the distal pivot axis 38 the angle of the support plates 12 and 14 and the mouse support plate 24 can be adjusted, whether to maintain a horizontal disposition or to achieve a positive or negative tilt as taught herein. For example, as is depicted in FIG. 20, the mouse support plate, the keyboard wrist support, the distal arms, and the distal pivot axis can be adjusted from the first, to the second, and to the third positions as indicated at 24, 24', and 24", 16, 16', and 16", 34, 34', and 34", and 38, 38', and 38".

In any case, the support arrangement 10 can be provided as original equipment or for installation relative to new or pre-existing support surfaces 200. Alternatively, embodiments of the support arrangement 10 can be crafted for being applied to sliding arrangements provided for prior art structures.

Figure 22:
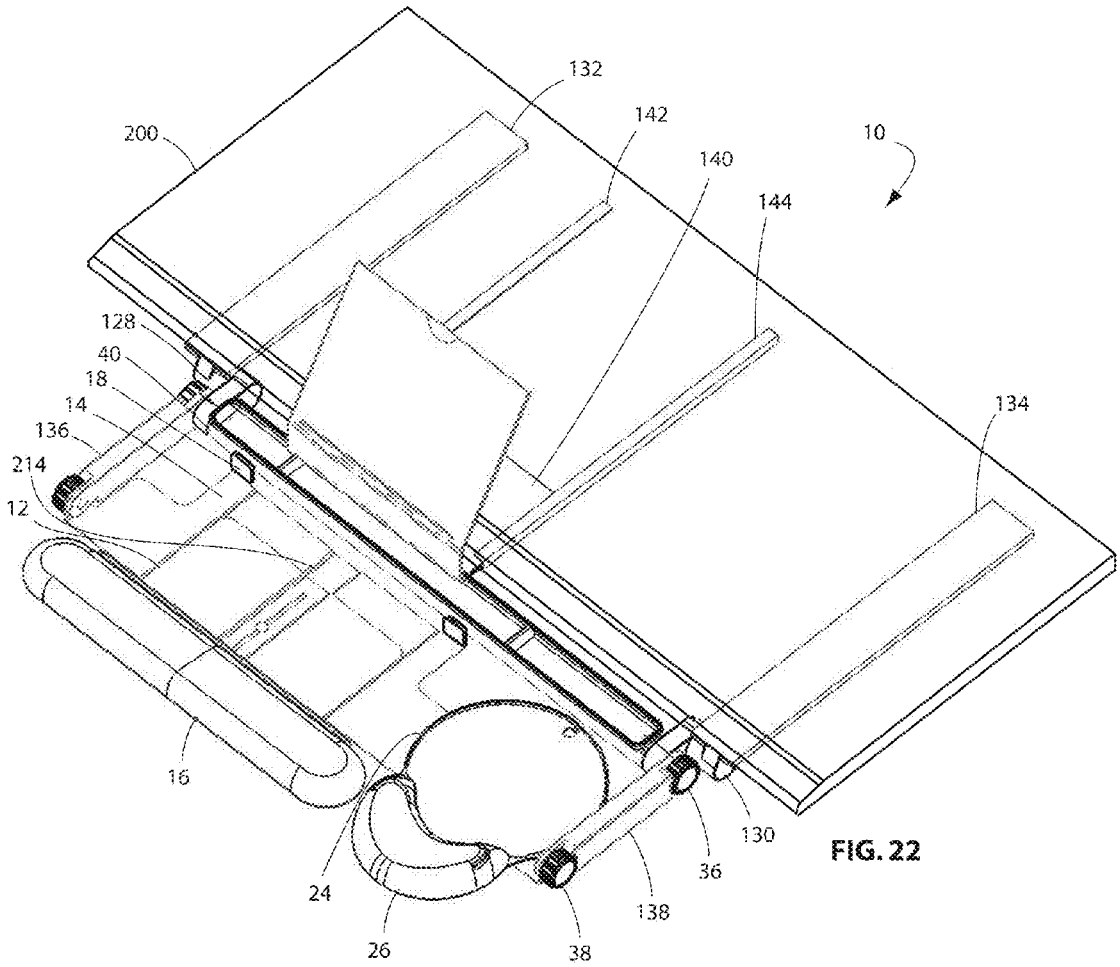
FIG. 22 is an upper perspective view of a further embodiment of the ergonomic keyboard, mouse, and wrist support disclosed herein.
Figure 23:
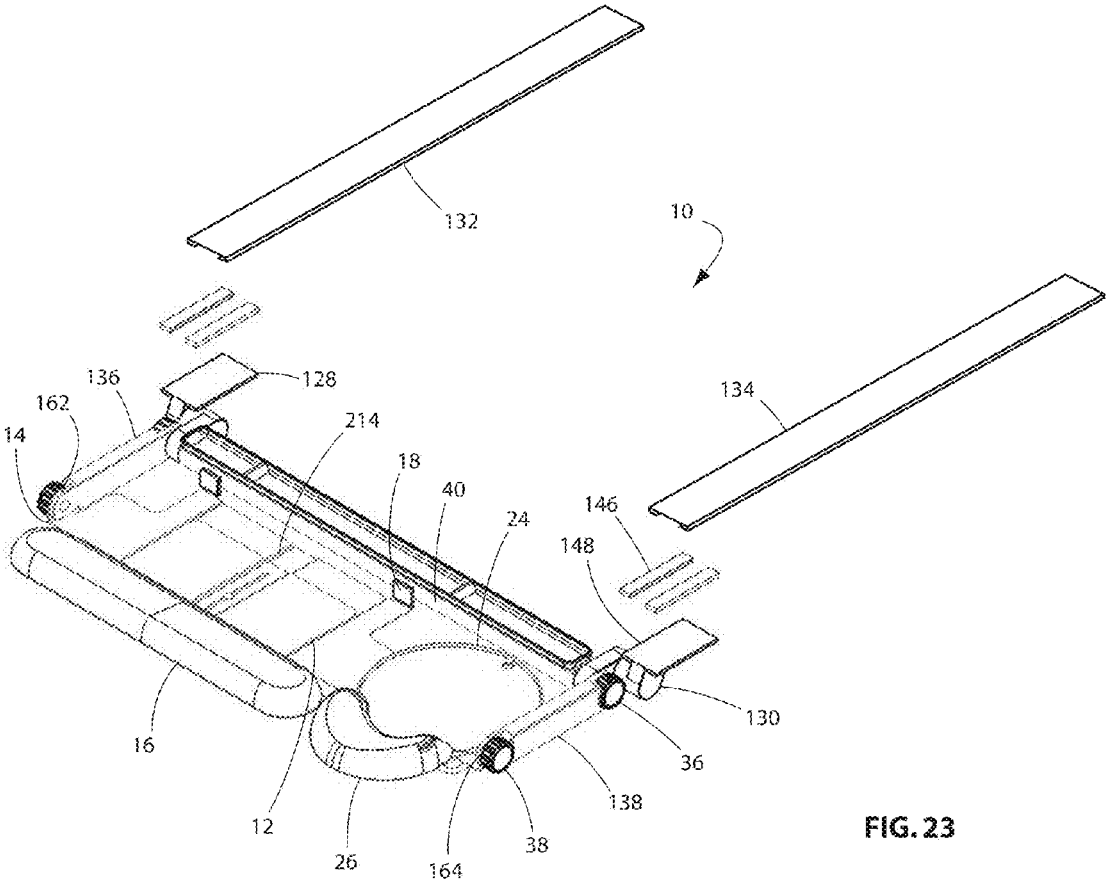
FIG. 23 is a partially exploded upper perspective view of the ergonomic keyboard, mouse, and wrist support.
Figure 30:
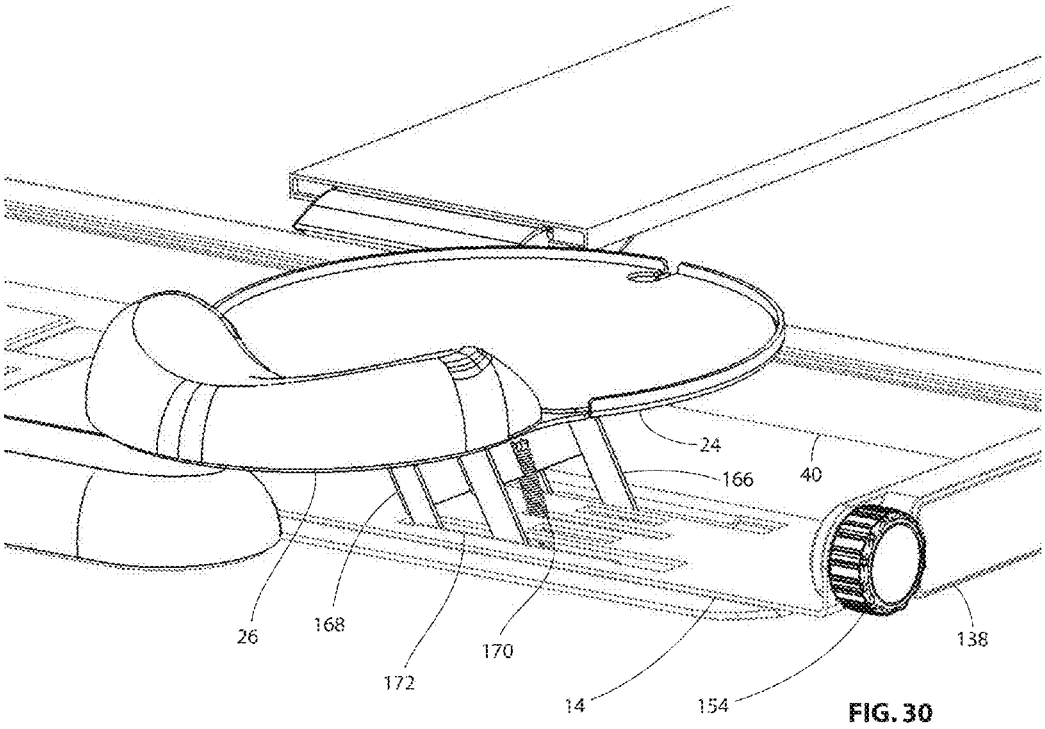
FIG. 30 is an upper perspective view of an adjustable mouse support.
Figure 31:
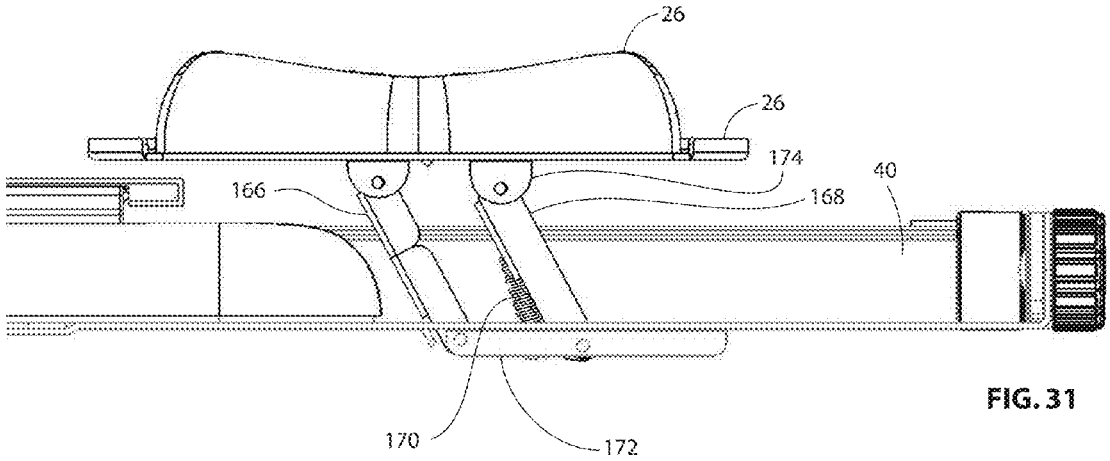
FIG. 31 is a view in front elevation of the adjustable mouse support of FIG. 30.

In the alternative embodiment of FIGS. 22 and 23, the keyboard support plate 14 has first and second upturned outboard end flanges 162 and 164 that extend to and are pivotally retained by the distal ends of parallel movement arms 136 and 138. The keyboard support plate 14 can again slidably engage the keyboard support plate 12 by use of a slot 22 and mating longitudinal channels 214 and 216 disposed in the plates 12 and 14. The support plate 14 in this embodiment also supports the mouse support plate 24 via a parallel movement arm arrangement as shown in FIGS. 30 and 31, which is discussed further hereinbelow.

The parallel movement arms 136 and 138 are pivotally retained at their proximal ends by a transverse member 40. The proximal ends of the parallel movement arms 136 and 138 and the ends of the transverse member 40 are coupled to sliding support bases 128 and 130. The sliding support bases 128 and 130 are slidably engaged with first and second slide tracks 132 and 134, and the tracks 132 and 134 can be fastened to a support surface 200. The sliding support bases 128 and 130 have a cross section, such as a T-shaped cross section that matingly engages a cross section, such as a C-shaped cross section, of the slide tracks 132 and 134. Low friction material glides 146 with C-shaped cross sections can be received over the upper legs of the T-shaped section of the sliding support bases 128 and 130 to enable smooth and consistent sliding of the arrangement. A plurality of wire management clips 180 are spaced along the transverse member 40 for retaining and controlling power and data wiring.

Figure 24:
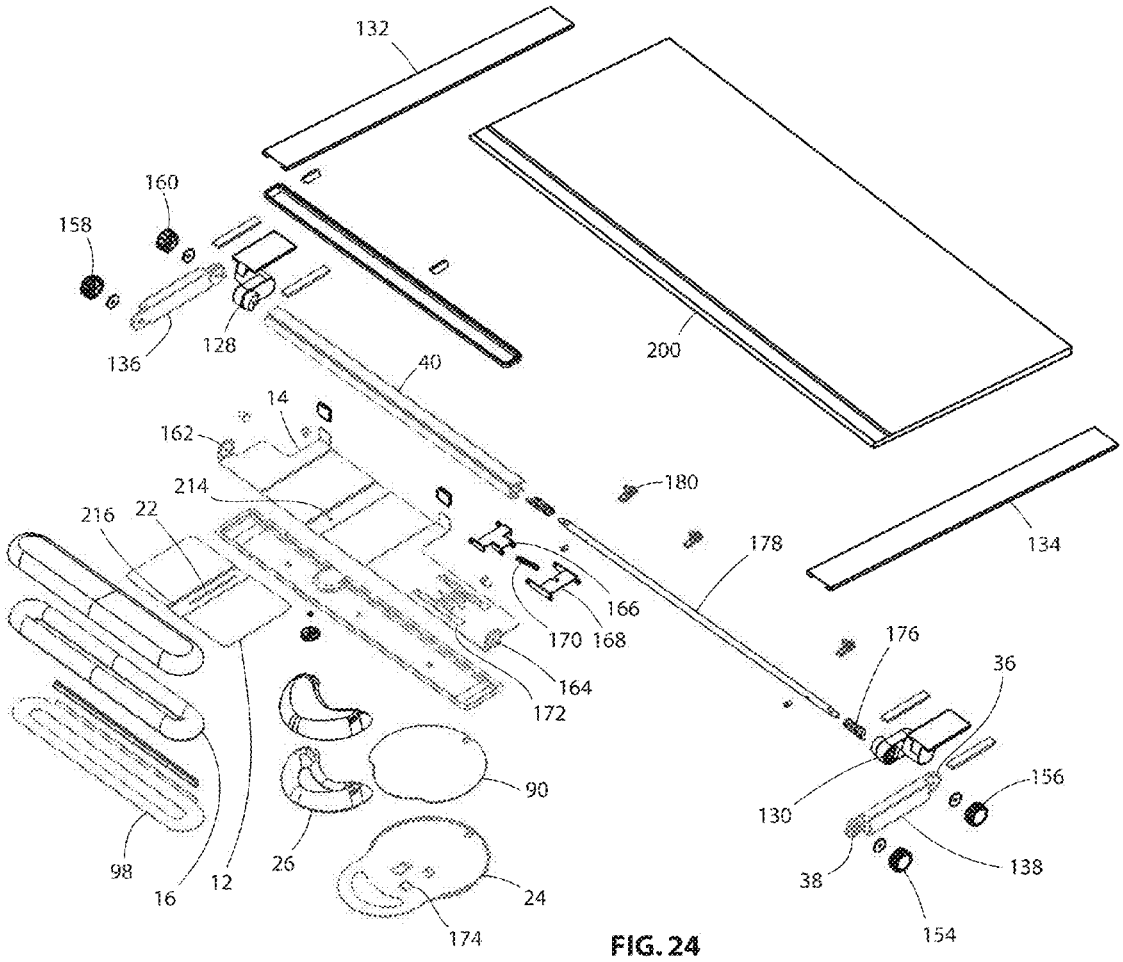
FIG. 24 is an exploded upper perspective view of another embodiment of the ergonomic keyboard, mouse, and wrist support disclosed herein.
Figure 25:
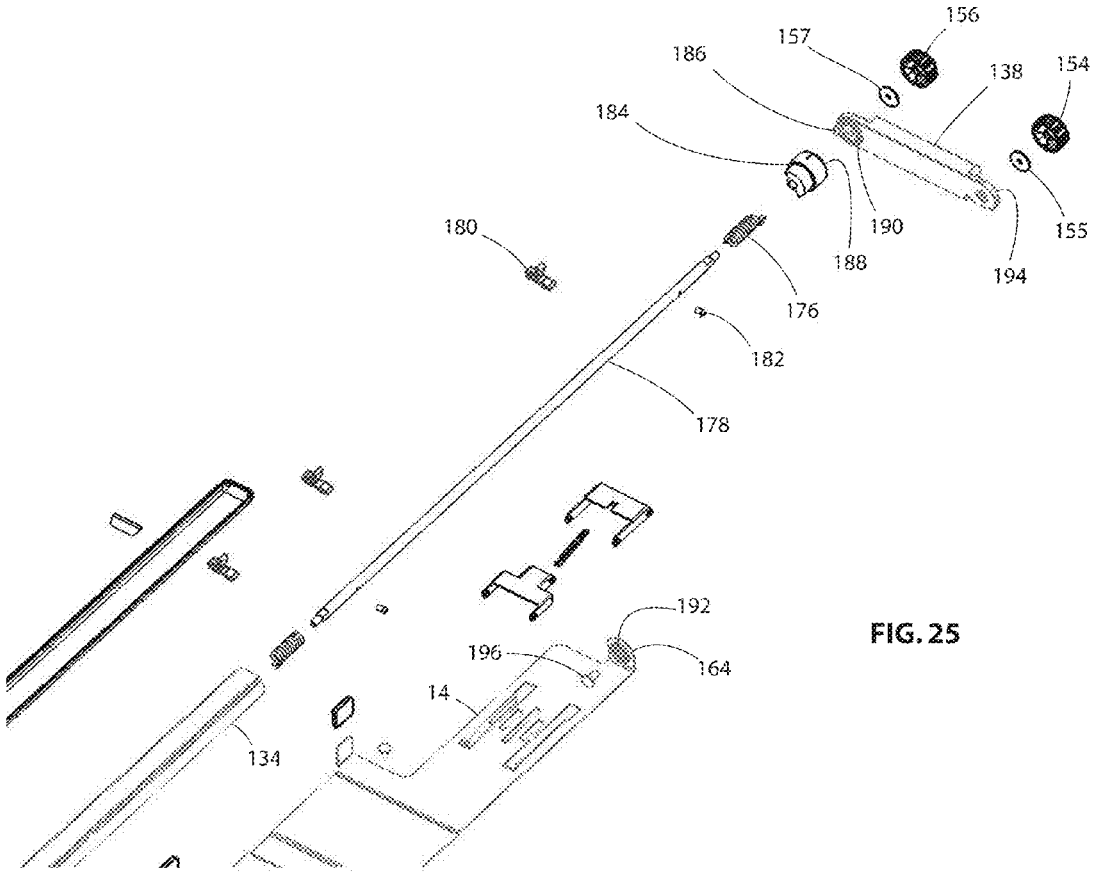
FIG. 25 is an exploded perspective view of a height adjustment arrangement portion of the ergonomic keyboard, mouse, and wrist support.
Figure 26:
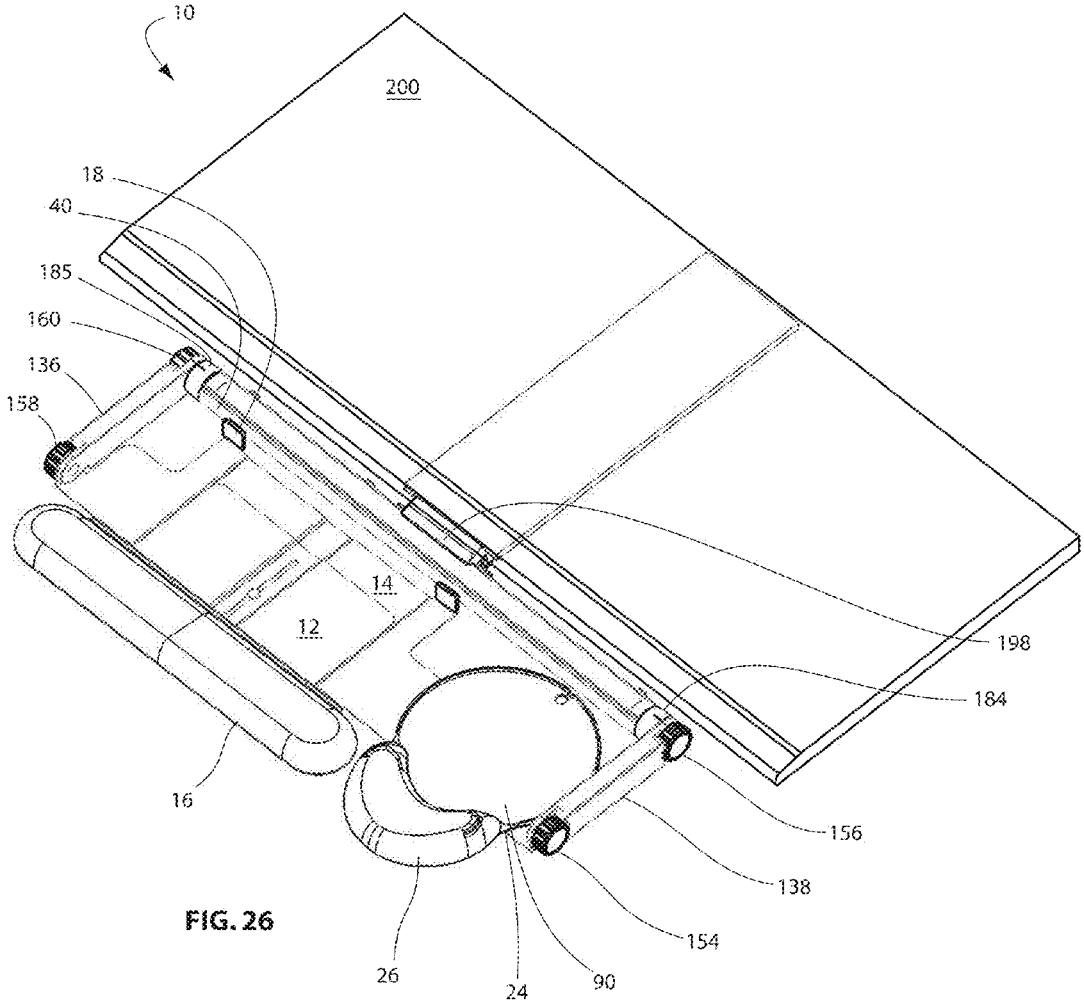
FIG. 26 is an upper perspective view of an ergonomic keyboard, mouse, and wrist support with a central arm support arrangement.
Figure 29:
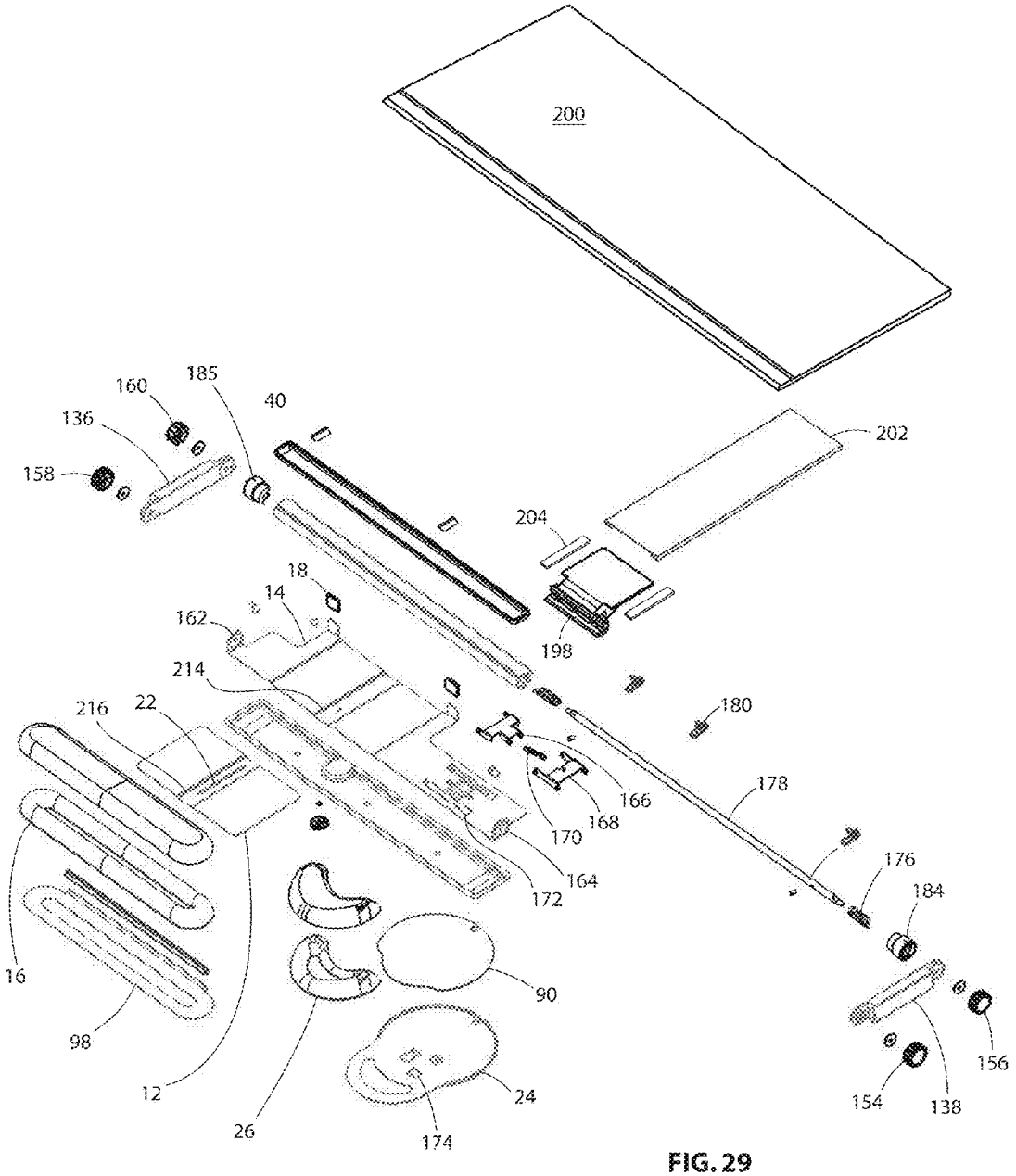
FIG. 29 is an exploded upper perspective view of the ergonomic keyboard, mouse, and wrist support of FIG. 26.

As can be perceived with further reference to the exploded views of FIGS. 24, 25, and 29, the proximal ends of the arms 136 and 138 are provided with a counterbalance spring arrangement, which provides counterbalancing support to the keyboard support plate 14 and the components supported thereby. The counterbalance spring arrangement in this example is established by left and right outboard torsion springs 176 that each have an inboard end fixed adjacent to an outboard end of a shaft 178 that is disposed within the transverse member 40 and an outboard end that is fixed in relation to the proximal ends of the respective arm 136 or 138. More particularly, the outboard ends of the springs 176 are fixed in relation to arm adaptors 184 and 185 by set pins 182, and the arm adaptors 184 and 185, in turn, are fixed to the inboard faces of the arms 136 and 138 by one or more inwardly projecting teeth 186.

Knobs 158 and 160 are threadedly engaged with the outboard ends of the shaft 178 whereby the arms 136 and 138 can be fixed at a given angular disposition by a selective tightening of the knobs 158 and 160 relative to the shaft 178. The outboard faces of the adaptors 184 and 185 and the contacting inboard faces of the proximal ends of the arms 136 and 138 have radially projecting teeth or other protuberances 188 and 190 that engage one another at each given angular disposition to prevent inadvertent pivoting of the arms 136 and 138. Similarly, the contacting faces of the upturned flanges 162 and 164 and the distal ends of the arms 136 and 138 can have radially projecting teeth or other protuberances 192 and 194 that engage one another at each given angular disposition of the support plate 14 to lock the support plate 14 and the retained components at a given angular disposition when the knobs 154 and 158 are tightened in relation to fastening bolts 196. Washers 155 and 157 are interposed between the knobs 154, 156, 158, and 160 to act as spacers. With this, the height, position, and angular disposition of the keyboard support plates 12 and 14 and the mouse support plate 24 can be readily adjusted to suit the user and particular applications.

In the embodiment of FIG. 24, support is provided to the transverse member 40, the retained arms 136 and 138, and the support plates 12, 14, and 24 by sliding support bases 128 and 130 that are slidably retained by first and second outboard rails 150 and 152. In the embodiments of FIGS. 26 through 29, slidable support is provided by a central mounting arm 198 that has a distal portion fixed to a mid-portion of the transverse member 40 and a proximal portion that is slidably engaged with a central mounting track 202. With combined reference to FIGS. 27 and 28, one can see that the central mounting arm 198 and the central mounting track 202 are engaged by mating cross sections. More particularly, the central mounting arm 202 has laterally projecting wings that are received into inwardly facing C-shaped channels of the mounting track 202. Arm glides 204 formed by low friction material are interposed between the wings of the central mounting arm 202 and the C-shaped channels of the mounting track 202 for enabling smooth and consistent sliding action. As shown in FIG. 27, the mounting arm 198 and the mounting track 202 have interference stops 206 and 208 for preventing an overextending and dislodging of the mounting arm 198.

The keyboard support plate 14 in the depicted embodiment has a first, broadened portion for providing support to a keyboard and a second, narrower peninsula portion for providing support to the mouse support plate 24 in a manner capable of being raised and moved laterally inwardly and lowered and moved laterally outwardly. With combined reference to FIGS. 29 through 31, the mouse support plate 24 can be seen to have a mounting arrangement thereon comprising centrally disposed, downturned retaining flanges 174 while the keyboard support plate 14 has a mounting arrangement thereon comprising downturned retaining flanges 172 and adjacent laterally disposed apertures in the support plate 14.

A first control arm 166 has what can be considered an inverted T shape with a base portion having first and second flanges for pivotally engaging the mouse support plate 24 and outboard legs with flanges for pivotally engaging the keyboard support plate 14. A second control arm 168 has what can be considered an inverted U shape with outboard flanges having first ends for pivotally engaging the keyboard support plate 14 and second ends for pivotally engaging the mouse support plate 24. The first and second control arms 166 and 168 are generally parallel. Together, the first and second control arms 166 and 168 and the mouse support plate 24 establish a parallel movement linkage. The laterally disposed apertures in the support plate 14 can receive the flanges of the control arms 166 and 168 to permit the mouse support plate 24 to be disposed substantially in contact with the keyboard support plate 14 when the mouse support plate is in a lowered position.

A tension spring 170 has a first end coupled to the keyboard support plate 14 to be below the upper surface of the support plate 14, such as by being coupled to a flange, and a second end coupled to the parallel movement linkage spaced from the keyboard support plate 14. In this embodiment, for example, the tension spring 170 has a first end coupled to the keyboard support plate 14 between the first and second control arms 166 and 168 and a second end coupled to the base of the inverted U shape established by the second control arm 168. With this, the mouse support plate 24 can be adjusted between a lowered position where the mouse support plate 24 is in substantial contact with and at a generally equal level to the keyboard support plate 14 and a raised position where the mouse support plate 24', the mouse wrist support 26', and the arms 166' and 168' are raised from the keyboard support plate 14. In each position, a triangular relationship will be established by the spring 170, the second control arm 168, and the keyboard support plate 14. With this, the tension of the spring 170 will tend to maintain the mouse support plate 24 in a lowered position with the control arms 166 and 168 received within the apertures in the keyboard support plate 14 and in a raised position when the arms 166 and 168 are pivoted past vertical as is shown in FIG. 31.

Figure 32A:
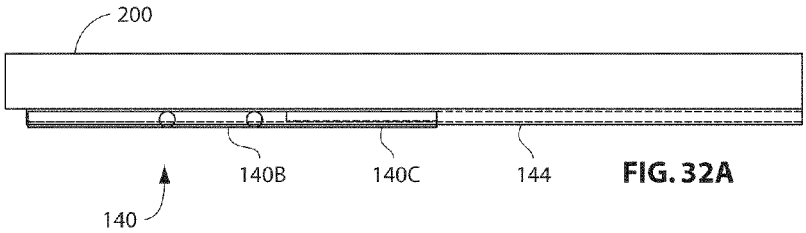
FIGS. 32A through 32D are successive views in side elevation of a document holder for use under the present invention.
Figure 32B:
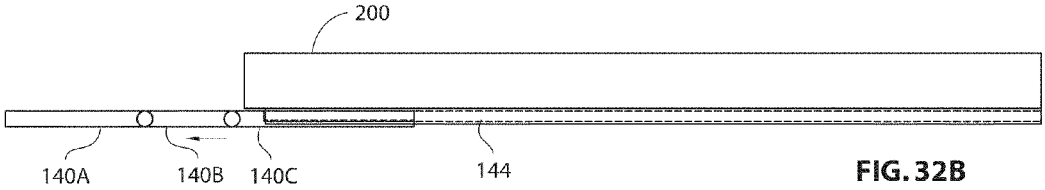
Figure 32C:
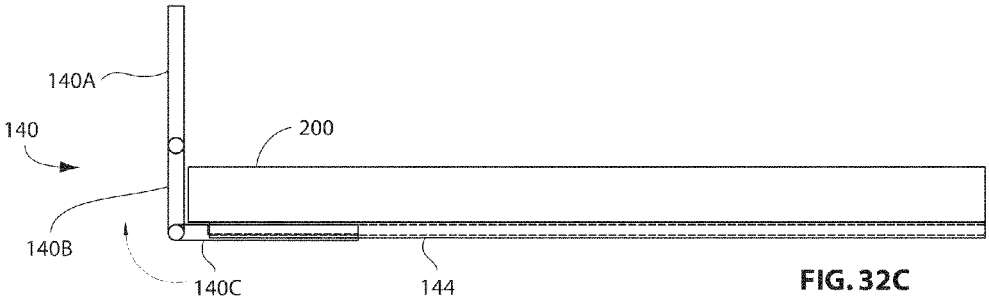
Figure 32D:
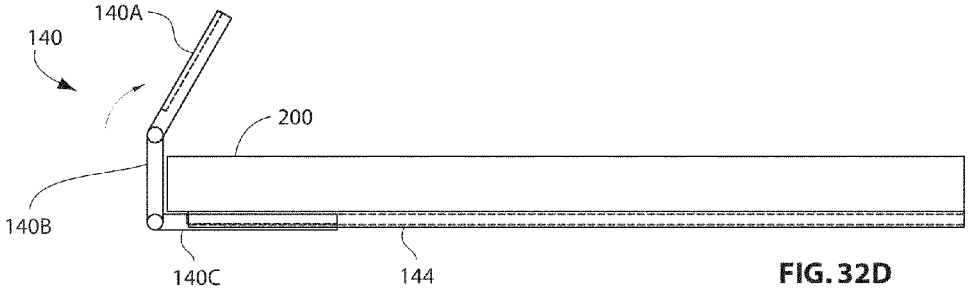

As shown in FIG. 22 and then in progressive views in FIGS. 32A through 32D, the support arrangement 10 can additionally include a segmented document holder 140 slidably retained by side rails 142 and 144 for enabling the support of documents and other items in addition to the mouse and keyboard support provided by the keyboard support plates 12 and 14 and the mouse support plate 24. The document holder 140 has a first section 140A coupled by a laterally disposed first hinge to a second section 140B that is, in turn, coupled to a third section 140C by a laterally disposed second hinge. The first section 140A can be sized to receive and support documents or other items. The second section 140B can have a height from the first hinge to the second hinge that is approximately equal to or slightly greater than the thickness of the desk or other support surface 200. The first hinge connecting the first and second sections 140A and 140B can have a stop built into it to restrict pivoting beyond a given degree as is shown in FIG. 32D.

With this, the document holder 140 can be disposed in a retracted position with all three sections 140A, 140B, and 140C as shown in FIG. 32A stored under the support surface 200. When the document holder 140 is desired to be used, it can be slid out from under the support surface 200 to the position shown in FIG. 32B where the first and second sections 140A and 140B extend beyond the support surface 200 while the third section 140C remains below the support surface 200 retained by the tracks 142 and 144. Then, the first and second sections 140A and 140B can be pivoted about the second hinge to an upright configuration as shown in FIG. 32C, and then the first section 140A can be pivoted beyond vertical to the position shown in FIG. 32D until the stop is reached.

Figure 33:
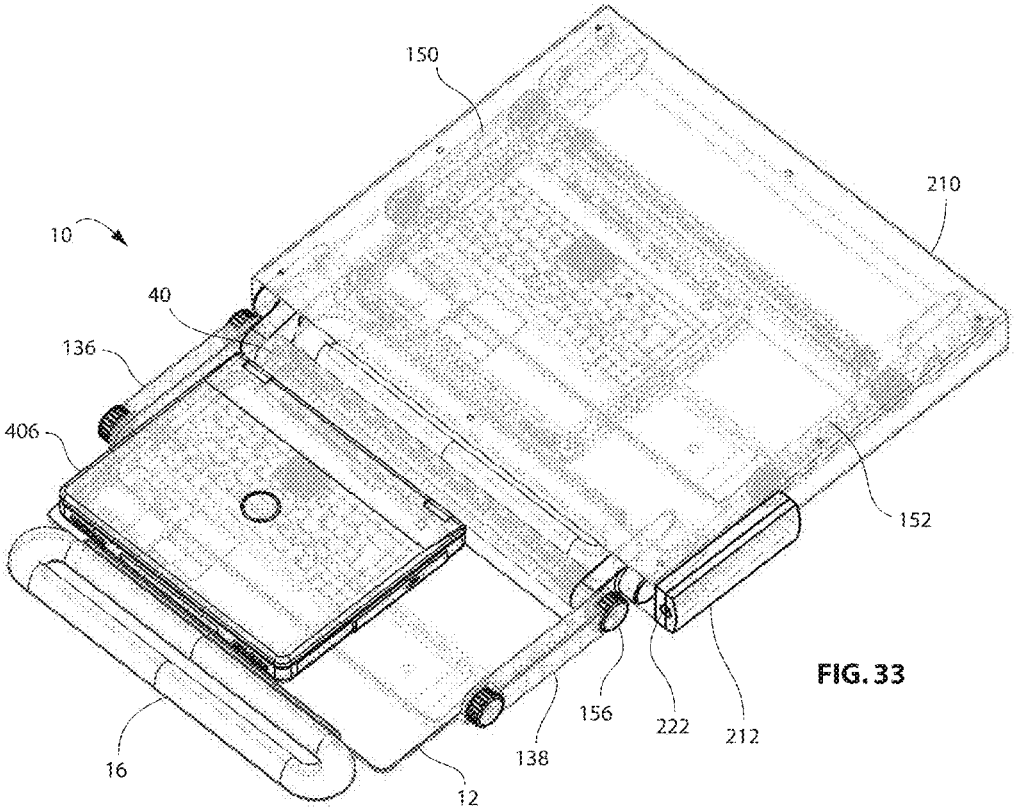
FIG. 33 is an upper perspective view of another support arrangement under the present invention.

As shown in FIG. 33, embodiments of the support arrangement 10 are contemplated wherein a protective storage compartment 210 is provided. The storage compartment 210 can enshroud the sliding rails 150 and 152 and, when the support arrangement 10 is in a refracted disposition, the arms 136 and 138, the support plate 12 and any other support members, the wrist support 16, and, most importantly, the components supported thereby, such as the laptop 406 or any other component. The storage compartment 210 can be rigid and fire resistant and can resist theft and fire and other damage to the retained components. A key lock box 212 operable by a key mechanism 222 or other selectively locking arrangement can lock the support arrangement 10 in a secured, storage configuration.

Figure 34:
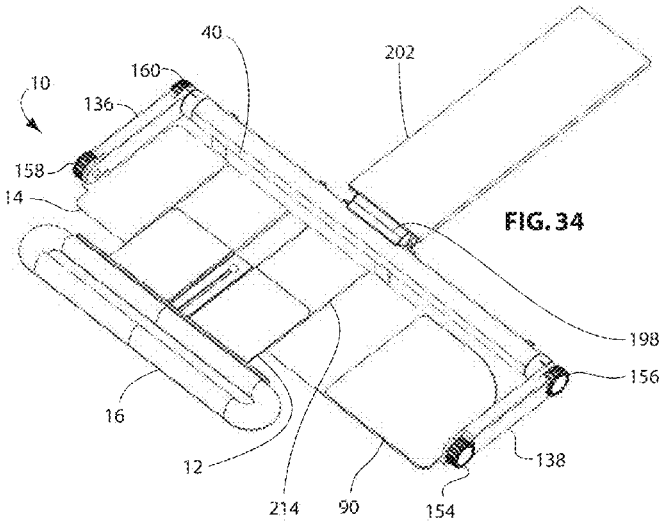
FIG. 34 is an upper perspective view of a central mount support arrangement with a combined keyboard and mouse support tray.
Figure 35:
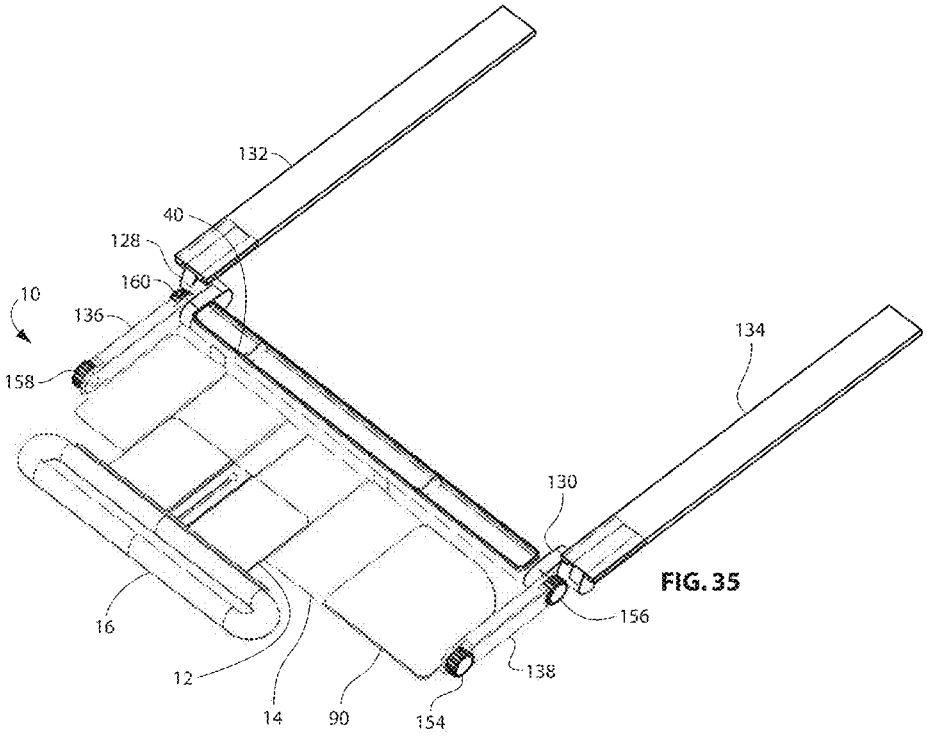
FIG. 35 is an upper perspective view of a side mount support arrangement with a combined keyboard and mouse support tray.
Figure 36:
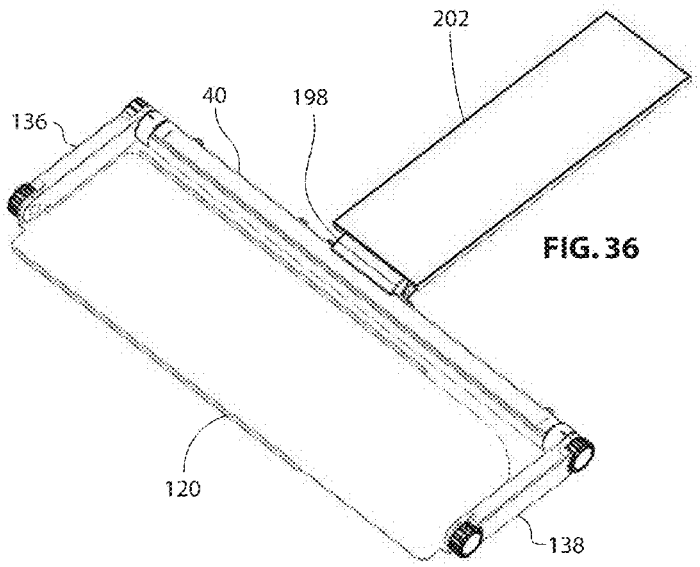
FIG. 36 is an upper perspective view of a further central mount support arrangement with a combined keyboard and mouse support tray.
Figure 37:
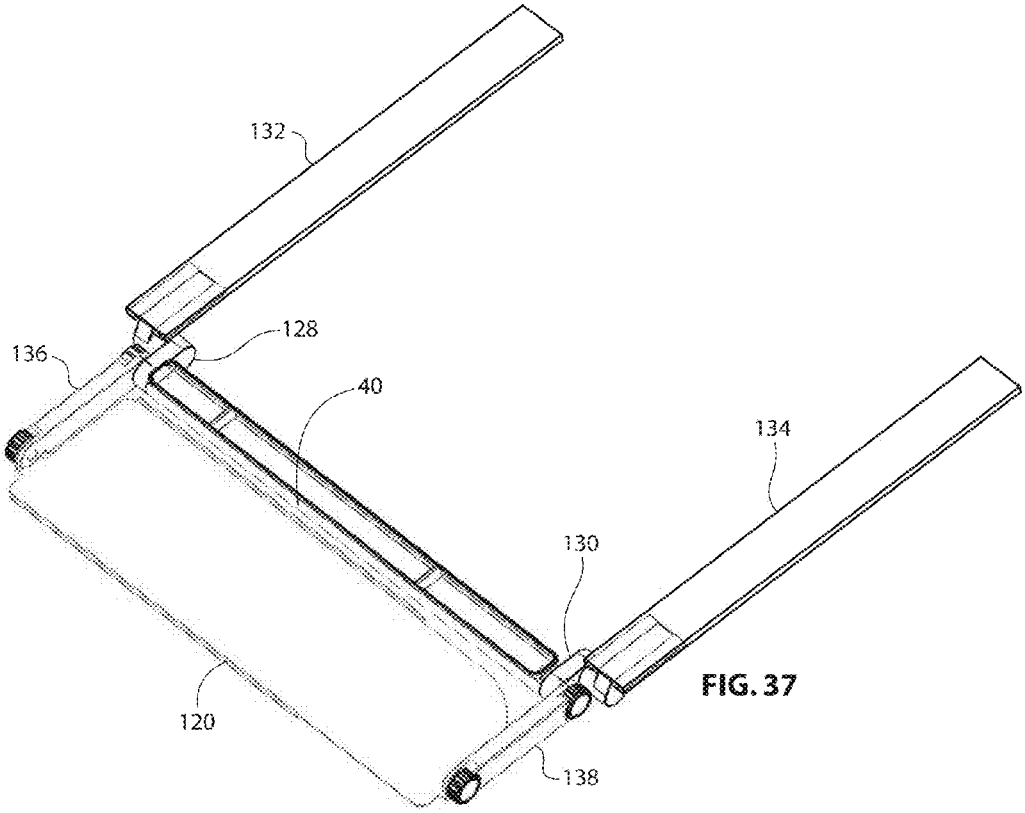
FIG. 37 is an upper perspective view of another side mount support arrangement with a combined keyboard and mouse support tray.

In the embodiment of FIG. 33, a single support plate 12 is provided for supporting a laptop 406, a keyboard, a mouse, and, additionally or alternatively, any other component. The arms 136 and 138 can be operable as previously described to provide pivoting adjustment of the height, angle, and relative position of the support plate 12. In FIG. 34, a central slide mounting track 202 retains a mounting arm 198 that is fixed to the transverse member 40. The transverse member 40 again pivotally retains the arms 136 and 138, which pivotally support the keyboard support plates 12 and 14. The mouse pad 90 in this embodiment is affixed directly to the support plate 14, which gain spans entirely from the first arm 136 to the second arm 138. The embodiment of FIG. 35 is similar except that first and second slide tracks 132 and 134 are employed to slidably retain sliding bases 128 and 130 as shown and described in relation to, for example, FIG. 23. The embodiments of FIGS. 36 and 37 correspond to the embodiments of FIGS. 34 and 35 except that a single support tray 120 is pivotally retained by the first and second arms 136 and 138 for efficiency in construction and use.

With certain details of the present invention disclosed, it will be understood by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A support arrangement comprising:

a first arm with a proximal end and a distal end;

a second arm with a proximal end and a distal end;

means for pivotally retaining the proximal end of the first arm;

means for pivotally retaining the proximal end of the second arm;

means for retaining the first and second arms for extension and retraction;

a transverse support member with a first end coupled to the distal end of the first arm and a second end coupled to the distal end of the second arm; and a keyboard support portion retained relative to the transverse support member;

wherein the first and second arms comprise parallel movement arms whereby the keyboard support portion can be maintained at a given orientation during a pivoting of the first and second arms.

2. The support arrangement of claim 1 wherein the keyboard support portion is pivotable about a lateral pivot axis relative to the distal ends of the first and second arms whereby the keyboard support portion can be pivoted to a negative tilt through an angle $\alpha$ and a positive tilt through an angle $\beta$.

3. The support arrangement of claim 1 wherein the keyboard support portion retained relative to the transverse support member comprises a portion of the transverse support member and further comprising a mouse support member retained relative to the transverse support member wherein the mouse support member is independently moveable in relation to the transverse support member.

4. A support arrangement comprising:

a first arm with a proximal end and a distal end;

a second arm with a proximal end and a distal end;

means for pivotally retaining the proximal end of the first arm;

means for pivotally retaining the proximal end of the second arm;

means for retaining the first and second arms for extension and retraction;

a transverse support member with a first end coupled to the distal end of the first arm and a second end coupled to the distal end of the second arm;

a keyboard support portion retained relative to the transverse support member; and a counterbalance spring arrangement that provides counterbalancing support to the proximal ends of the first and second arms.

5. The support arrangement of claim 4 wherein the counterbalance spring arrangement comprises a torsion spring with a first end fixed in relation to the proximal end of the first arm and a second end fixed in relation to the means for pivotally retaining the proximal end of the first arm.

6. The support arrangement of claim 5 further comprising a transverse stabilizing member wherein the means for retaining the proximal end of the first arm comprises a first end of the transverse stabilizing member and wherein the means for retaining the proximal end of the second arm comprises a second end of the transverse stabilizing member.

7. The support arrangement of claim 6 wherein the means for retaining the proximal end of the first arm further comprises a first side member, wherein the means for retaining the proximal end of the second arm further comprises a second side member, and wherein the means for retaining the first and second arms for extension and retraction comprises a means for slidably engaging the first and second side members.

8. The support arrangement of claim 6 wherein the means for retaining the first and second arms for extension and retraction comprises a means for slidably retaining a central portion of the transverse stabilizing member.

9. The support arrangement of claim 4 further comprising a protective storage compartment that enshrouds the first arm, the second arm, the transverse support member, and the keyboard support portion when the first arm, the second arm, the transverse support member, and the keyboard support portion are in a retracted position.

10. A support arrangement comprising:

a first arm with a proximal end and a distal end;

a second arm with a proximal end and a distal end;

means for pivotally retaining the proximal end of the first arm;

means for pivotally retaining the proximal end of the second arm;

means for retaining the first and second arms for extension and retraction;

a transverse support member with a first end coupled to the distal end of the first arm and a second end coupled to the distal end of the second arm wherein the first end of the transverse support member has a flange that pivotally engages the distal end of the first arm and wherein the second end of the transverse support member has a flange that pivotally engages the distal end of the second arm; and a keyboard support portion retained relative to the transverse support member wherein the keyboard support portion is pivotable about a lateral pivot axis relative to the distal ends of the first and second arms whereby the keyboard support portion can be pivoted to a negative tilt through an angle $\alpha$ and a positive tilt through an angle $\beta$.

11. The support arrangement of claim 10 further comprising angular position markings disposed to indicate an angular position of the first and second arms.

12. The support arrangement of claim 10 wherein the keyboard support portion retained relative to the transverse support member comprises a portion of the transverse support member.

13. The support arrangement of claim 10 further comprising a segmented document holder and a means for slidably supporting the segmented document holder.

14. The support arrangement of claim 13 further comprising a means for selectively locking the first arm, the second arm, the transverse support member, and the keyboard support portion in the retracted position.

15. A support arrangement comprising:

a first arm with a proximal end and a distal end;

a second arm with a proximal end and a distal end;

means for pivotally retaining the proximal end of the first arm;

means for pivotally retaining the proximal end of the second arm;

means for retaining the first and second arms for extension and retraction;

a transverse support member with a first end coupled to the distal end of the first arm and a second end coupled to the distal end of the second arm;

a keyboard support portion retained relative to the transverse support member; and a mouse support member retained relative to the transverse support member wherein the mouse support member is independently moveable in relation to the keyboard support member by a parallel movement arrangement to have a raised position and a lowered position.

16. The support arrangement of claim 15 wherein the parallel movement arrangement comprises a first control arm with a first end pivotally coupled to the transverse support member and a second end pivotally coupled to the mouse support member and a second control arm with a first end pivotally coupled to the transverse support member and a second end pivotally coupled to the mouse support member.

17. The support arrangement of claim 16 further comprising a tension spring coupled to the parallel movement arrangement to bias the mouse support member toward the raised position when the mouse support member is in a raised position and toward the lowered position when the mouse support member is in a lowered position.

18. The support arrangement of claim 17 wherein the tension spring has a first end coupled to the keyboard support member to be below an upper surface of the keyboard support member and a second end coupled to the parallel movement arrangement spaced from the keyboard support member.

19. The support arrangement of claim 18 wherein the first end of the spring is coupled to the keyboard support member between the first ends of the first and second control arms.

20. The support arrangement of claim 16 further comprising laterally disposed apertures in the transverse support member wherein the first and second control arms are received into the laterally disposed apertures in the transverse support plate when the mouse support member is in a lowered position.

21. A support arrangement comprising:

a first arm with a proximal end and a distal end;

a second arm with a proximal end and a distal end;

means for pivotally retaining the proximal end of the first arm;

means for pivotally retaining the proximal end of the second arm;

means for retaining the first and second arms for extension and retraction;

a transverse support member with a first end coupled to the distal end of the first arm and a second end coupled to the distal end of the second arm; and a keyboard support portion retained relative to the transverse support member;

wherein the means for retaining the first and second arms for extension and retraction comprises a sliding support base coupled to the proximal ends of the first and second arms and a slide rail that slidably receives the sliding support base wherein the sliding support base and the slide rail have portions with mating cross sections.

22. The support arrangement of claim 21 wherein the sliding support base has a portion with a T-shaped cross section and wherein the slide rail has a portion with a C-shaped cross section for receiving the T-shaped cross section of the sliding support base.

23. The support arrangement of claim 21 further comprising low friction material glide members interposed between the mating cross sections of the sliding support base and the slide rail.

24. The support arrangement of claim 21 wherein the means for retaining the first and second arms for extension and retraction comprises first and second sliding support bases coupled to the proximal ends of the first and second arms and first and second slide rails that slidably receive the first and second sliding support bases wherein the sliding support bases and the slide rails have portions with mating cross sections.

* * * * *